US012599809B2

(12) United States Patent
Benda et al.

(10) Patent No.: US 12,599,809 B2
(45) Date of Patent: Apr. 14, 2026

(54) HANDLE DRIVING MECHANISM FOR LOCOMOTION REHABILITATION

(71) Applicant: HEALING INNOVATIONS, INC., Nashville, TN (US)

(72) Inventors: Scott Douglas Benda, Hendersonville, TN (US); Benjamin Howland Taylor, Nashville, TN (US)

(73) Assignee: Healing Innovations, Inc., Nashville, TN (US)

( * ) Notice: Subject to any disclaimer, the term of this patent is extended or adjusted under 35 U.S.C. 154(b) by 235 days.

(21) Appl. No.: 18/501,348

(22) Filed: Nov. 3, 2023

(65) Prior Publication Data

US 2024/0149103 A1 May 9, 2024

Related U.S. Application Data

(60) Provisional application No. 63/422,151, filed on Nov. 3, 2022.

(51) Int. Cl.

| | |
|---|---|
| ***A63B 22/00*** | (2006.01) |
| ***A63B 21/00*** | (2006.01) |
| ***A63B 21/005*** | (2006.01) |
| ***A63B 24/00*** | (2006.01) |

(52) U.S. Cl.

CPC .... *A63B 22/0056* (2013.01); *A63B 21/00181* (2013.01); *A63B 21/0058* (2013.01); *A63B 21/154* (2013.01); *A63B 21/4034* (2015.10); *A63B 21/4035* (2015.10); *A63B 22/001* (2013.01); *A63B 24/0087* (2013.01); *A63B 2022/0094* (2013.01); *A63B 2209/08* (2013.01)

(58) Field of Classification Search

CPC ..... A63B 22/0048; A63B 22/0056; A63B 22/0061; A63B 22/04

See application file for complete search history.

(56) References Cited

U.S. PATENT DOCUMENTS

| | | | | |
|---|---|---|---|---|
| 4,169,589 A * | 10/1979 | McArthur | A63B 23/0417 482/135 |
| 5,595,555 A * | 1/1997 | Chen | A63B 22/0056 434/255 |
| 9,248,071 B1 * | 2/2016 | Benda | A63B 71/0009 |
| 2005/0049117 A1 * | 3/2005 | Rodgers | A63B 22/0664 482/52 |
| 2020/0078251 A1 * | 3/2020 | Benda | A61H 3/008 |
| 2020/0171350 A1 * | 6/2020 | Hilburn, III | A63B 23/1218 |

* cited by examiner

*Primary Examiner* — Zachary T Moore

(74) *Attorney, Agent, or Firm* — Bradley Arant Boult Cummings LLP; Daniel E. Sineway, Esq.

(57) ABSTRACT

A system can comprise a driving link, a first footplate link, a footplate, a pulley system, a second footplate link, and a handle. The driving link can rotate, to thereby cause the first footplate link to translate in a first direction. The translation of the first footplate link footplate in the first direction can cause the footplate and the second footplate link to translate in the first direction when the first footplate link translates in the first direction. The translation of the second footplate link in the first direction can transmit force to the handle via the pulley system, thereby causing the handle to translate in a second direction that is substantially opposite the first direction when the first footplate link the footplate, and the second footplate link are translating in the first direction.

20 Claims, 16 Drawing Sheets

HANDLE DRIVING MECHANISM FOR LOCOMOTION REHABILITATION

CROSS REFERENCE TO RELATED APPLICATIONS

This application claims the benefit of and priority to U.S. Provisional Patent Application No. 63/422,151, filed on Nov. 3, 2022 and entitled "HANDLE DRIVING MECHANISM FOR LOCOMOTION REHABILITATION," the disclosure of which is incorporated by reference in its entirety as if the same were fully set forth herein.

TECHNICAL FIELD

The present systems and processes relate generally to driving handles for locomotion rehabilitation.

BACKGROUND

A primary objective of locomotive rehabilitation is often to restore a subject's strength and/or retrain the subject to walk in a natural gait cycle, under the subject's own power. A given locomotive rehabilitation subject may lack sufficient strength (e.g., in the legs, feet, core, etc.) to move his or her extremities through a normal gait cycle. Alternatively or in addition, a given subject may lack sufficient coordination to correctly position or direct his or her extremities through a gait cycle. For example, a stroke patient may experience muscle weakness and diminished coordination in his or her legs, and, thus, may be incapable of walking under his or her own power. Some existing locomotive rehabilitation systems and machines are configured to guide a subject through a full or partial gait cycle, to thereby increase coordination and muscle strength. However, such existing locomotive rehabilitation systems and machines typically involve complicated machinery to effect the simulated gait cycles. For example, some existing systems can rely on inner workings that include numerous gears, mechanical linkages, and containment brackets. And as the number of components and levels of complication and intricacy increase, the cost of production can increase and/or the opportunity for mechanical failure can also increase, which can, in turn, lead to increased maintenance costs.

Therefore, there exists a long-felt but unmet need for a locomotive rehabilitation system that includes a simplified design using fewer components than existing systems, while also enabling simulated gait cycles, particularly with respect to footplates and/or handles.

BRIEF SUMMARY

These and other problems are addressed by the technology disclosed herein. Briefly described, aspects of the present disclosure generally relate to handle systems, mechanisms, and/or processes for driving handles. Such handle systems, mechanisms, and/or processes can be useful in multiple scenarios, such as locomotion rehabilitation systems, mechanisms, and/or processes.

The disclosed technology includes a handle translation and synchronization system (referred to herein as a "linkage system"). The linkage system can be configured to facilitate, transmit, translate, or cause movement of one or more handles in response to movement of one or more footplates, one or more footplate links, and/or a driving link. The linkage system can be configured to synchronize handle and footplate movement such that the synchronized movements mimic a natural human walking gait (e.g., any suitable movement gait, such as a semi-assisted walking gait, shuffling gait, etc.).

It will be understood and appreciated that the systems and devices described herein can include more than a single linkage system. For example, the disclosed technology can include two or more linkage systems. For example, a sled (e.g., a sled 103, as shown in FIG. 1 and described herein) can include two linkage systems, one for each paired foot and hand (e.g., a first pair of the left leg/foot and left arm/hand, a second pair of the right leg/foot and right arm/hand). The various linkage systems can be standalone linkage systems (e.g., a first linkage system can be mechanically separated from a second linkage system). Alternatively, the various linkage systems can be mechanically linked (e.g., via one or more intermediate linkages disposed between, or in mechanical communication with, the various linkage systems (e.g., a first linkage system and a second linkage system can be in mechanical communication with one another). Alternatively or in addition, the various linkage systems can be simultaneously or otherwise coordinatedly controlled by a common linkage system and/or controller (e.g., an electronic controller). A given linkage system can include, but is not limited to, a driving link, a first footplate link (e.g., an outer footplate link), a footplate, a second footplate link (e.g., an inner footplate link), a belt, a pulley system (e.g., a plurality of pulleys), and/or a handle. The linkage system can be configured to convert rotation of the driving link into a synchronized translation of the footplate in a first direction and the handle in a second direction that is opposite the first direction (e.g., via the various link(s), pulley(s), and belt). The linkage system can be adjusted or reconfigured to adjust various gait attributes including, but not limited to, foot stride length, hand stride length, hand-foot synchronization ratio, hand-hand synchronization ratio, foot-foot synchronization ratio, assisted gait, and adverse gait (e.g., slippage, trip, restraint, encumbrance).

A driving link can be configured to rotate in response to rotation of a driving mechanism. An outer footplate link can be connected to the driving link at or near a first end of the outer footplate link and configured to rotate and translate (e.g., reverse rotate and reverse translate) in response to rotation of the driving link. The outer footplate link can be connected to a footplate at or near a second end of the outer footplate link. The footplate can be configured to translate, or reverse translate, in response to movement of the outer footplate link. An inner footplate link can be connected to the footplate at or near a first end of the inner footplate link. The inner footplate link can be connected to a carriage at or near a second end of the inner footplate link. The inner footplate link can be configured to translate, or reverse translate, in response to movement of the footplate. The carriage is configured to translate, or reverse translate, along a carriage rail, to thereby stabilize the forward or reverse translation of the inner footplate link.

The inner footplate link can be connected to a belt at or near the second end of the inner footplate link. The belt can be supported by a pulley system (e.g., two or more pulleys) such that belt includes at least a first portion and a second portion opposite the first portion. The inner footplate link can be connected to, or otherwise in mechanical communication with, the first portion of the belt (e.g., via a clamp or other attachment apparatus or device). The inner footplate link can be connected to the belt such that the belt rotates (e.g., alternatingly rotates in clockwise and counterclockwise directions) about the two or more pulleys in response to, or in conjunction with, translation or reverse translation of the inner footplate link.

A second clamp can be configured to connect to, or disconnect from, the belt in response to input from, or actions caused by, an engagement mechanism. For example, the engagement mechanism can include an electromagnet. Upon being activated, the electromagnet can cause the second clamp to connect to the belt (e.g., via compression against the belt). In response to being deactivated, the electromagnet can cause or permit the second clamp to disconnect from the belt (e.g., via release of the compression against the belt). When connected to the belt (e.g., compressed against the belt), the second clamp can be configured to translate, or reverse translate, in response to rotation of the belt about the two or more pulleys.

A handle can be connected to, or otherwise in mechanical communication with, the second clamp. As a non-limiting example, the handle can be connected to the second clamp via a rib. For example, the rib can be connected to the second clamp at a first end of the second clamp and to the handle at a second end of the second clamp. The handle can be configured to translate in response to translation of the second clamp and when the second clamp is connected to the belt. The handle can be connected to a second carriage. The second carriage can be configured to translate, or reverse translate, along a second carriage rail, to thereby stabilize the forward or reverse translation of the inner handle.

The belt and pulley system can synchronize translations of the footplate with translations of the handle. For example, in response to rotation of the driving link, the outer footplate link can translate in a first direction, thereby causing the footplate and the inner footplate link to translate in the first direction. The translation of the inner footplate link can cause translation of the clamp in the first direction and, thereby, rotation of the belt about the pulley system (e.g., two or more pulleys). The rotation of the belt can cause translation of the second clamp in a second direction that is opposite the first direction (e.g., reverse translation). The translation of the second clamp can cause translation of the handle in the second direction, thereby synchronizing translation of the footplate with opposing translation of the handle in a manner mimicking natural human gait (e.g., with the hand on a given side moving in a forward direction as the foot on the same side moves in rearward direction and moving in the rearward direction as the foot moves in the forward direction).

The disclosed technology includes a system that can comprise a driving link, a first footplate link, a footplate, a pulley system, a second footplate link, and/or a handle. The driving link can be configured to rotate in a rotational direction. The first footplate link can be in mechanical communication with the driving link, and the first footplate link can be configured to translate in a first direction in response to rotation of the driving link in the rotational direction. The footplate can be in mechanical communication with the first footplate link such that the footplate is configured to translate in the first direction when the first footplate link translates in the first direction. The pulley system can comprise one or more pulleys and a belt that can be in mechanical communication with the one or more pulleys. The second footplate link can be in mechanical communication with the first footplate link and a first belt portion of the belt, and the second footplate link can be configured to translate in the first direction when the first footplate link translates in the first direction, thereby causing the first belt portion to translate in the first direction and a second belt portion to translate in a second direction that is substantially opposite the first direction. The handle can be in mechanical communication with the second belt portion of the belt when the handle is in an engaged state such that, when the footplate translates in the first direction, the handle translates in the second direction.

The second footplate link can be in mechanical communication with the first footplate link via the footplate.

The rotational direction can be a first rotational direction, and the belt can be configured to rotate in a second rotational direction when the driving link rotates in the first rotational direction, the second rotational direction being opposite the first rotational direction.

The handle can be selectively detachable from the second belt portion, and the handle can be in a disengaged state when the handle is detached from the second belt portion.

The system can further comprise an engagement system configured to transition the handle between the engaged state and the disengaged state.

The engagement system can be configured to transition the handle between the engaged state and the disengaged state in response to receiving an instruction signal from a computing device.

The system can further comprise a handle restraining element configured to restrict translation of the handle when the handle is in the disengaged state.

The system can further comprise a rib attached to the handle and disposed between the handle and a handle attachment point that is configured to selectively engage the second belt portion. The handle restraining element can comprise a magnet configured to magnetically attach to the rib to thereby restrict translation of the handle when the handle is in the disengaged state. The magnet can be a permanent magnet or an electromagnet.

The driving link can be in mechanical communication with a motor.

The system can further comprise a carriage configured to translate along a carriage rail extending parallel to the first direction and the second direction, and the carriage can be in mechanical communication with the second footplate link to thereby stabilize translation of the second footplate link.

The system can further comprise a stride length track and a driving linkage connecting the driving link to the first footplate link. The driving linkage can be configured to traverse along the stride length track, and a position of the driving linkage along the stride length track can correspond to a magnitude of translation for the first footplate link.

The system can further comprise a stride length actuator configured to controllably adjust the position of the driving linkage along the stride length track.

The stride length actuator can be configured to adjust the position of the driving linkage along the stride length track in response to receiving an instruction signal from a computing device.

The system can further comprise a controller configured to selectively operate the system according to any one of a plurality of gait operation modes. Alternatively or in addition, the controller can be configured to selectively operate the system according any one of a plurality of stride lengths, any one of a plurality of gait speeds, and/or any one of a plurality of power-assist levels.

The disclosed technology includes a system that can comprise a sled, a first linkage system attached to the sled, and a second linkage system attached to the sled. Both of the first and second linkage systems can comprise a driving link, a first footplate link, a footplate, a pulley system, a second footplate link, and/or a handle. For both the first and second linkage systems, the driving link can be configured to rotate in a rotational direction. For both the first and second linkage systems, the first footplate link can be in mechanical communication with the driving link, and the first footplate link can be configured to translate in a first direction in response to rotation of the driving link in the rotational direction. For both the first and second linkage systems, the footplate can be in mechanical communication with the first footplate link such that the footplate is configured to translate in the first direction when the first footplate link translates in the first direction. For both the first and second linkage systems, the pulley system can comprise one or more pulleys and a belt that can be in mechanical communication with the one or more pulleys. For both the first and second linkage systems, the second footplate link can be in mechanical communication with the first footplate link and a first belt portion of the belt, and the second footplate link can be configured to translate in the first direction when the first footplate link translates in the first direction, thereby causing the first belt portion to translate in the first direction and a second belt portion to translate in a second direction that is substantially opposite the first direction. For both the first and second linkage systems, the handle can be in mechanical communication with the second belt portion of the belt when the handle is in an engaged state such that, when the footplate translates in the first direction, the handle translates in the second direction. The footplate of the first linkage system and the handle of the second linkage system can be configured to translate in the second direction when the footplate of the second linkage system and the handle of the first linkage system translate in the first direction. Alternatively or in addition, the footplate of the second linkage system and the handle of the first linkage system can be configured to translate in the second direction when the footplate of the first linkage system and the handle of the second linkage system translate in the first direction.

For each of the first and second linkage systems, the second footplate link can be in mechanical communication with the first footplate link via the footplate.

For each of the first and second linkage systems, the handle can be selectively detachable from the second belt portion, and the handle can be in a disengaged state when the handle is detached from the second belt portion.

Each of the first and second linkage systems can further comprise an engagement system configured to transition the corresponding handle between the engaged state and the disengaged state.

Each of the first and second linkage systems can further comprise a stride length track and a driving linkage connecting the driving link to the corresponding first footplate link. The driving linkage can be configured to traverse along the stride length track, and a position of the driving linkage along the stride length track can correspond to a magnitude of translation for the first footplate link.

Each of the first and second linkage systems can further comprise a stride length actuator configured to controllably adjust the position of the driving linkage along the stride length track.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE FIGURES

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
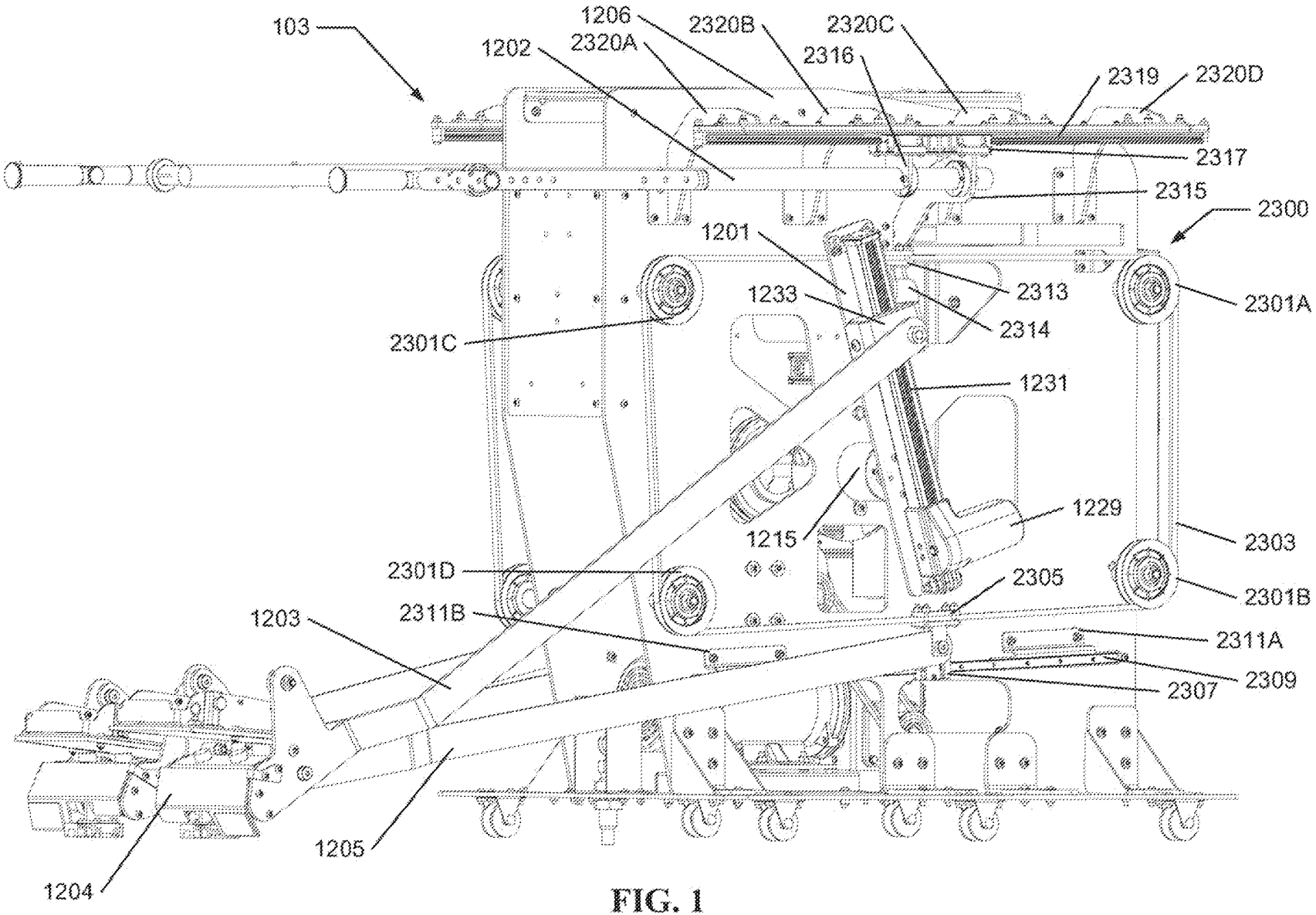
FIG. 1 shows a perspective view of an example linkage system, in accordance with the disclosed technology.

For the purpose of promoting an understanding of the principles of the present disclosure, reference will now be made to the examples and embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. Stated otherwise, the disclosed technology can be embodied in many different forms and should not be construed as limited to the specific examples set forth herein. The components described hereinafter as making up various elements of the disclosed technology are intended to be illustrative and not restrictive. Other suitable components that would perform the same or similar functions as components described herein are intended to be embraced within the scope of the disclosed electronic devices and methods. Such other components not described herein may include, but are not limited to, for example, components developed after development of the disclosed technology. In any event, all limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Throughout this disclosure, certain components are described as connecting to certain other components. As used herein, the phrase "connected to" (or similar phrases) includes both a direct connection between the subject components as well as a mechanical communication or an indirect connection between the subject components (e.g., via intermediate components), unless otherwise provided herein. For example, a first component "connected to" a second component encompasses both (1) the first component being directly connected or attached to the second component and/or (2) the first component being in mechanical communication with the second component via one or more third components.

This application is related to U.S. application Ser. No. 17/875,038, filed Jul. 27, 2022 and entitled "REHABILITATION DEVICE PROVIDING LOCOMOTION TRAINING AND METHOD OF USE, which is a continuation of, and claims the benefit of and priority to, U.S. application Ser. No. 16/902,836, now U.S. Pat. No. 11,432,985, filed Jun. 16, 2020 and entitled "REHABILITATION DEVICE PROVIDING LOCOMOTION TRAINING AND METHOD OF USE," which is a continuation of, and claims the benefit of and priority to, U.S. patent application Ser. No. 16/565,131, now U.S. Pat. No. 10,736,808, filed Sep. 9, 2019 and entitled "REHABILITATION DEVICE PROVIDING LOCOMOTION TRAINING AND METHOD OF USE," which claims the benefit of, and priority to, U.S. Patent Application No. 62/728,762, filed Sep. 8, 2018, entitled "REHABILITATION DEVICE PROVIDING LOCOMOTIVE TRAINING AND METHOD OF USE," the disclosures of which are incorporated by reference in their entireties as if the same were fully set forth herein.

Overview

Aspects of the present disclosure generally relate to systems and processes for synchronizing handle and footplate motion in a manner substantially mimicking human gait cycles and various attributes thereof.

Example Embodiments

Referring now to the figures, for the purposes of example and explanation of the fundamental processes and components of the disclosed systems and processes, reference is made to FIG. 1, which shows a perspective view of an example linkage system 2300. As will be understood and appreciated, the linkage system 2300 and other elements shown in FIG. 1 represent merely one approach, implementation, or embodiment of the disclosed technology, and other aspects can be used or implemented according to various elements and/or embodiments of the disclosed technology.

The linkage system 2300 can be implemented on a sled 103. The sled 103 can include multiple linkage systems 2300. For example, the sled 103 can include a first linkage system 2300 configured to synchronize motions of a left foot and a left hand and a second linkage system 2300 configured to synchronize motions of a right foot and a right hand (e.g., in addition to collectively synchronizing motions of the foot pairs and hand pairs). Several references are made herein to a singular linkage system 2300. It should be noted that such descriptions are attributable to the singular linkage system 2300 or each of a plurality of linkage system 2300 (e.g., two linkage systems 2300, such as on a single sled 103, configured to synchronize motions of corresponding foot/hand pairs of a user). As further shown and described herein (e.g., with respect to FIGS. 2 and 5), one or more elements of the linkage system(s) 2300 can be affixed to a frame 1206.

Figure 14:
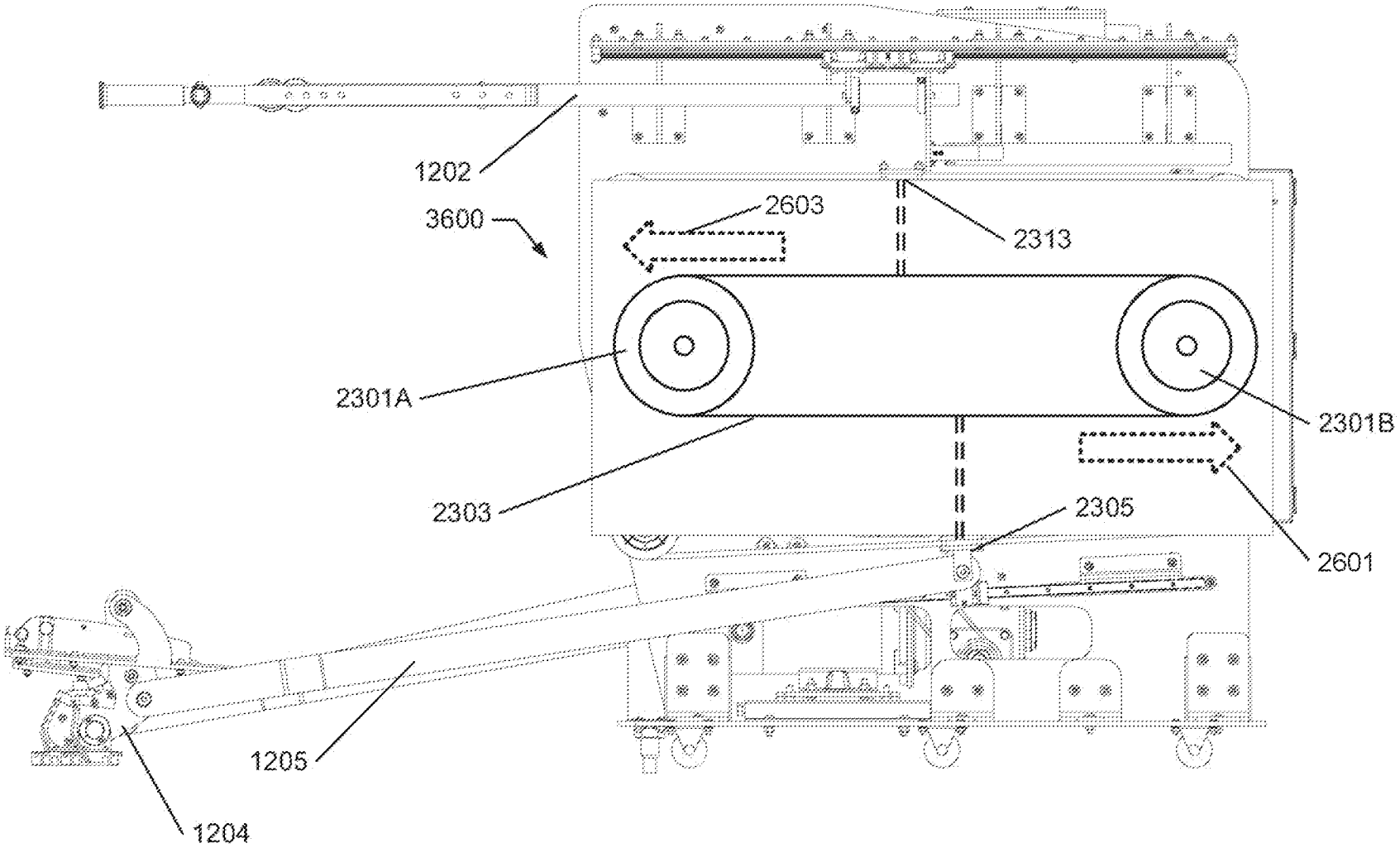
FIG. 14 shows a side view of an example linkage system, in accordance with the disclosed technology.
Figure 15:
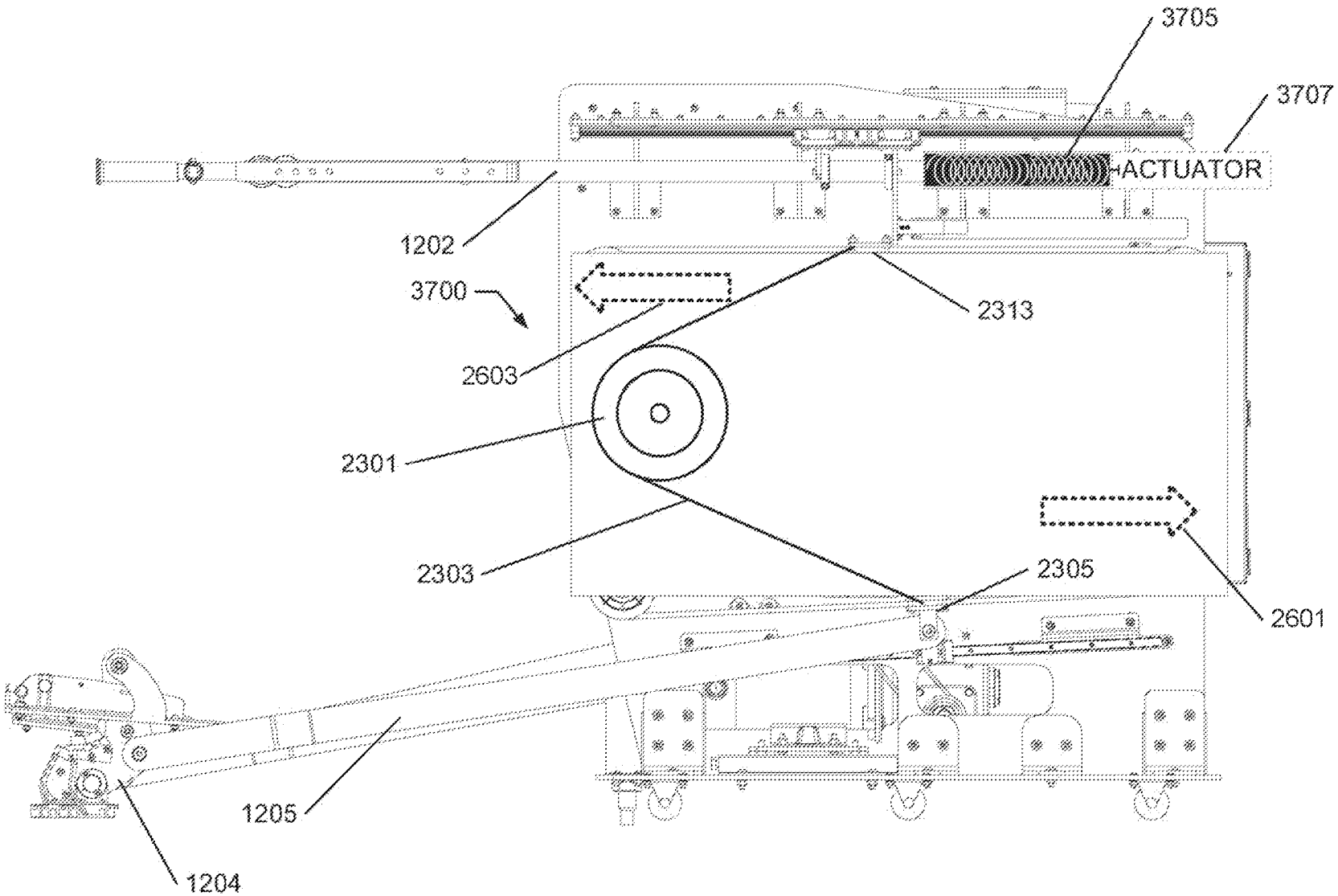
FIG. 15 shows a side view of an example linkage system, in accordance with the disclosed technology.

The linkage system 2300 can synchronize movements of a footplate 1204 and a handle 1202 in a manner substantially mimicking natural human walking gaits and various attributes thereof (e.g., impaired gaits, assisted gaits, trips, slips, stumbles, encumbrances, etc.). The linkage system 2300 can include, but is not limited to, a driving link 1201, a handle 1202, a footplate 1204, an outer footplate link 1203, an inner footplate link 1205, a belt 2303, and/or one or more pulleys 2301 (e.g., pulleys 2301A, 2301B, 2301C, and/or 2301D, which can be referenced generally as pulley(s) 2301). As shown in FIG. 1 and as described herein, the linkage system 2300 can include four pulleys 2301. Alternatively, as shown in FIG. 14 and as described herein, the linkage system 2300 can include two pulleys 2301. Alternatively, as shown in FIG. 15 and as described herein, the linkage system 2300 includes one pulley 2301. The linkage system 2300 can include any other number of pulleys 2301 (e.g., three pulleys 2301, five or more pulleys 2301), depending on desired system behaviors and other characteristics.

The driving link 1201 can be connected to a driving link mechanism 1215. The driving link mechanism 1215 can be configured to rotate in response to rotational force from a motor unit (not shown), a gear system in communication with a motor unit, and/or a clutch mechanism in communication with a gear system or a motor unit. The driving link 1201 can be configured to rotate in response to rotation of the driving link mechanism 1215. For example, the driving link 1201 can be secured to the driving link mechanism 1215 such that the driving link 1201 rotates in tandem with the driving link mechanism 1215 and/or in a predetermined ratio to the rotation of the driving link mechanism 1215.

The driving link 1201 can be connected to the outer footplate link 1203 such that the rotation of the driving link 1201 can cause rotation and/or translation of the outer footplate link 1203.

The driving link 1201 can be oriented at an initial point of a full rotation (e.g., 0 degrees of a 360-degree rotation). Alternatively or in addition, the outer footplate link 1203 can be oriented at a maximum reverse translation point. As the driving link 1201 rotates from the initial point to a halfway point of the rotation, the driving link 1201 can cause the outer footplate link 1203 to forward translate to a maximum forward translation point. As the driving link 1201 rotates through the full rotation (e.g., from the halfway point to the initial point of the rotation), the driving link 1201 can cause the outer footplate link 1203 to reverse translate to the maximum forward translation point. As will be appreciated by those having skill in the art, this exemplary scenario can correspond to the linkage system 2300 simulating the motion of a human foot throughout a natural gait cycle.

A driving linkage 1233 can connect the driving link 1201 to the outer footplate link 1203 such that the driving link 1201 can rotate about the driving link mechanism 1215 and, thereby, can cause rotation and/or translation of the outer footplate link 1203. The driving link 1201 can include, or can have affixed thereto, a stride length track 1231. The driving linkage 1233 can interface with the stride length track 1231 such that the driving linkage 1233 can traverse along the stride length track 1231. The position of the driving linkage 1233 along the stride length track 1231 can determine the magnitude of translation of the outer footplate link 1203, thereby providing means for adjusting the length of a stride being simulated by motion of the outer footplate link 1203. The driving link 1201 can include, or can have affixed thereto, a stride length actuator 1229 (e.g., one or more of an electric motor, a stepper motor, a screw jack, a servomechanism, a solenoid cylinder, a hydraulic cylinder, or any combination thereof, as non-limiting examples). The stride length actuator 1229 can be configured to controllably adjust the position of the driving linkage 1233 along the stride length track 1231. The stride length actuator 1229 can be configured to be adjustable manually or automatically (e.g., without a user physically making adjustments).

The outer footplate link 1203 can be connected to a footplate 1204 such that the footplate 1204 can translate or reverse translate in response to motion of the outer footplate link 1203. The inner footplate link 1205 can be connected to the footplate 1204, or the outer footplate link 1203, such that the inner footplate link 1205 can translate or reverse translate in response to motion of the footplate 1204, or outer footplate link 1203.

The inner footplate link 1205 can be connected to the belt 2303 such that the belt 2303 can rotate about the pulley(s) 2301 (e.g., pulleys 2301A-2301D) in response to translation or reverse translation of the inner footplate link 1205. The inner footplate link 1205 can be connected to the belt 2303, such as via a clamp 2305. The inner footplate link 1205 can be affixed to a first end of the clamp 2305. A second end of the clamp 2305 can include a plate and bolt mechanism for securely connecting the clamp 2305 to the belt 2303. The clamp 2305 can secure to the belt 2303, such as via static frictional forces, magnetic forces, one or more fasteners, adhesives, or combinations thereof.

The inner footplate link 1205 can be connected to a carriage 2307. The carriage 2307 can interface with a carriage rail 2309. The carriage 2307 can be configured to translate, or reverse translate, along the carriage rail 2309, thereby stabilizing the forward or reverse translation of the inner footplate link 1205. The carriage rail 2309 can be secured to the frame 1206, such as via one or more rail plates 2311A, 2311B and/or appropriate fasteners (e.g., bolts, screws, rivets, etc.).

It should be noted that the terms "outer" and "inner" with respect to the outer footplate link 1203 and the inner footplate link 1205 are merely reflective of the configuration illustrated in the figures (e.g., the corresponding position of the outer footplate link 1203 relative to that of the inner footplate link 1205 and vice versa), and alternative configurations are contemplated. For example, a footplate link having the characteristics discussed herein as being those of the inner footplate link 1205 can alternatively be embodied by an "outer" footplate link, and likewise, a footplate link having the characteristics discussed herein as being those of the outer footplate link 1203 can alternatively be embodied by an "inner" footplate link. Accordingly, it should be understood that the characteristics of the outer and inner footplate links 1203, 1205 can alternatively be referenced as first and second footplate links 1203, 1205.

The handle 1202 can be configured to translate or reverse translate in response to motion of the belt 2303. The handle 1202 can be connected to the belt 2303 via a rib 2315 and/or a clamp 2313 configured to secure to the belt 2303. The handle 1202 can be connected to a first end of the rib 2315 (e.g., via one or more fasteners, welds, etc.). The clamp 2313 can be connected to a second end of the rib 2315. For example, the clamp 2313 can include two plates positioned on either side of the belt 2303. The plates of the clamp 2313 can be configured to compress against the belt 2303, thereby mechanically linking the clamp 2313, rib 2315, and handle 1202 to the belt 2303 (e.g., and, via the inner footplate link 1205, the footplate 1204). The clamp 2313 can be configured to controllably connect and disconnect from the belt 2303.

The linkage 2300 can include an engagement mechanism 2314 configured to controllably engage and disengage the clamp 2313 to and from the belt 2303. The engagement mechanism 214 can be controlled via one or more computing devices (not shown). The engagement mechanism 2314 can include an electromagnet. In response to receiving an activation signal (e.g., from a controller), the engagement mechanism 2314 can connect the clamp 2313 to the belt 2303 (e.g., via compression of the plates against the belt 2303, formation of a connection through the belt 2303, or another suitable mode or mechanism). In response to receiving a deactivation signal (e.g., from the controller), the engagement mechanism 2314 can disconnect the clamp 2313 from the belt 2303 (e.g., via release of the compression against the belt 2303, removal of a connection through the belt 2303, or another suitable mode or mechanism). When connected to the belt 2303, the clamp 2313 can be configured to translate, or reverse translate, in response to rotation (e.g., alternating clockwise and counterclockwise rotation) of the belt about the two or more pulleys. The engagement mechanism 2314 can be configured to disengage, re-engage, or partially engage the clamp 2313 to simulate one or more gait attributes including, but not limited to, impaired gaits, assisted gaits, trips, slips, stumbles, encumbrances, etc.). For example, momentary disengagement and re-engagement of the clamp 2313 can be performed to simulate an adverse gait event, such as slippage of a walking aid or a trip. Engagement and/or disengagement can be initiated or performed by a user, such as a physical therapist overseeing therapy for a patient. This can be helpful in many instances, such as a scenario in which a patient who suffered a stroke, resulting in one hand being held close to the body and unable to reach the corresponding handle. In such instances, the therapist or other user is enabled to disengage the handle corresponding to the non-functioning hand, while maintaining engagement of the opposite handle corresponding to the patient's functional hand to thereby fully move the functional arm through the corresponding arm motions of a normal gait cycle (or any other gait cycle). In another illustrative (but non-limiting) instance, a patent may have the ability to move both arms but may lack strength in his or her arms or hands, such that use of both handles would be advantageous to the patient. In such a scenario, the therapist or other user is enabled to engage both handles to move both patient's arms through the corresponding arm motions of a normal gait cycle (or any other gait cycle).

One or more engagement mechanisms 2314 can be configured to synchronize, in concert or alternation, the motion of respective handles 1202 of separate linkages 2300. The respective handles 1202 of two linkages 2300 (e.g., for two corresponding foot/hand pairs) can be configured to translate in equal proportion and direction, thereby simulating a walking aid, such as a walking frame. A handle 1202 of a first linkage 2300 can be configured to translate at a first rate (e.g., a first ratio of belt motion to handle motion, or of footplate motion to belt motion) and a second handle 1202 of a second linkage 2300 is configured to translate at a second rate greater than or less than the first rate (e.g., thereby simulating gait disorders such as disproportionate functionality of limbs).

Alternatively or in addition, the handle(s) 1202 can be adjustable to different lengths (e.g., the distance between the grip of the handle 1202 and the clamp 2313, the distance between the grip of the handle 1202 and the rib 2315) and/or can be adjustable to different angles (e.g., relative to ground). As such, the handle(s) 1202 can be positioned to accommodate various users or patients. As a non-limiting example, the handle can include two or more arms (e.g., two or more longitudinal portions) that can be slideable and/or rotatably connected together. For example, the two or more arms can be linked together, or otherwise connected, via an attachment device or component, such as a bolt and nut, a gear system, a spring and detect mechanism, or the like. As a further example, the handle 1202 can include a first arm including or attached to the clamp 2313 and a second arm including or attached to the grip. The second arm can be slideable along some or all of the first arm when the attachment device or component is loosened or released. Alternatively or in addition, the second arm can be rotated relative to the first arm when the attachment device or component is loosened or released.

The rib 2315 can be configured to translate, or reverse translate, in response to motion of the clamp 2313 (e.g., when the clamp 2313 is engaged with the belt 2303). The handle 1202 can be configured to translate, or reverse translate, in response to motion of the rib 2315. The handle 1202 can be connected to one or more carriages 2317. The carriage 2317 can be configured to interface with a carriage rail 2319 such that the carriage 2317 can translate forward and backward along the carriage rail 2319. The carriage 2317 and rail 2319 can help to stabilize the forward or reverse translation of the handle 1202. The carriage rail 2319 can be secured to the frame 1206, such as via one or more gussets 2320A-2320D and/or fasteners (e.g., bolts, screws, rivets, etc.). The handle 1202 can be secured to the frame 1206 via the carriage 2317, carriage rail 2319, and gusset(s) 2320A-2320D (e.g., or other suitable structure(s) or mechanism(s) for securing the carriage rail 2319 to the frame 1206). The gussets 2320A-2320D, carriage 2317, and/or the carriage rail 2319 can be configured to provide sufficient stiffness and mechanical strength to the handle 1202 such that the handle 1202 can support a subject's mass, or a portion thereof. The handle 1202 can simulate a walking aid, or portion thereof, such as, for example, a cane, walking frame, crutch, or knee scooter. The handle 1202 can include one or more sensors configured to measure subject weight being supported by or applied to the handle 1202.

Figure 2:
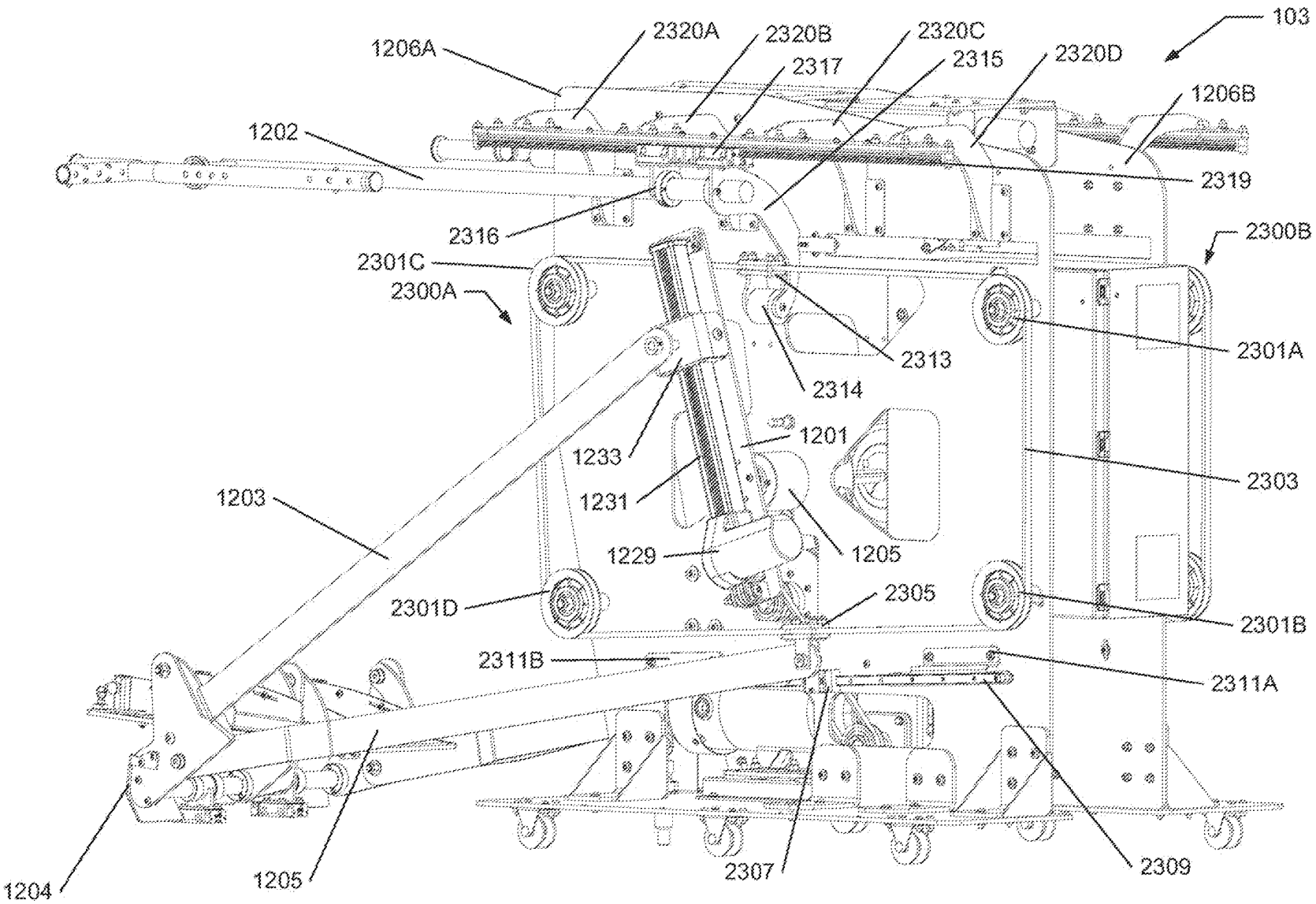
FIG. 2 shows a perspective view of an example linkage system, in accordance with the disclosed technology.

FIG. 2 shows a perspective view of an example linkage system 2300. The sled 103 can include a first plate 1206A and a second plate 1206B. The sled 103 can include a first linkage system 2300A affixed to the first plate 1206A and a second linkage system 2300B affixed to the second plate 1206B. By way of the linkage system(s) 2300, the sled 103 can simulate one or more human movement gaits, including, but not limited to, a natural gait, an impaired gait, an assisted gait, a left-preferential gait, a right-preferential gait, a walking gait, a shuffling gait, a step-by-step gait, or combinations thereof. As shown in the figures and described herein, operation of the linkage system(s) 2300 can be engaged via a corresponding driving link 1201 configured to rotate in response to a driving link mechanism 1205 and can engage with an outer footplate link 1203. Alternatively, the driving link 1201 can be configured to engage with the handle 1202 such that rotation of the driving link 1201 translates or reverse translates the handle 1202 (e.g., in parallel fashion, such as parallel to the ground). For example, the motion of the handle 1202 can cause rotation of the belt 2303 about the pulley(s) 2301, thereby causing translation or reverse translation of the footplate 1204 via motion of a belt-connected outer footplate link 1203 or inner footplate link 1205.

Figure 3:
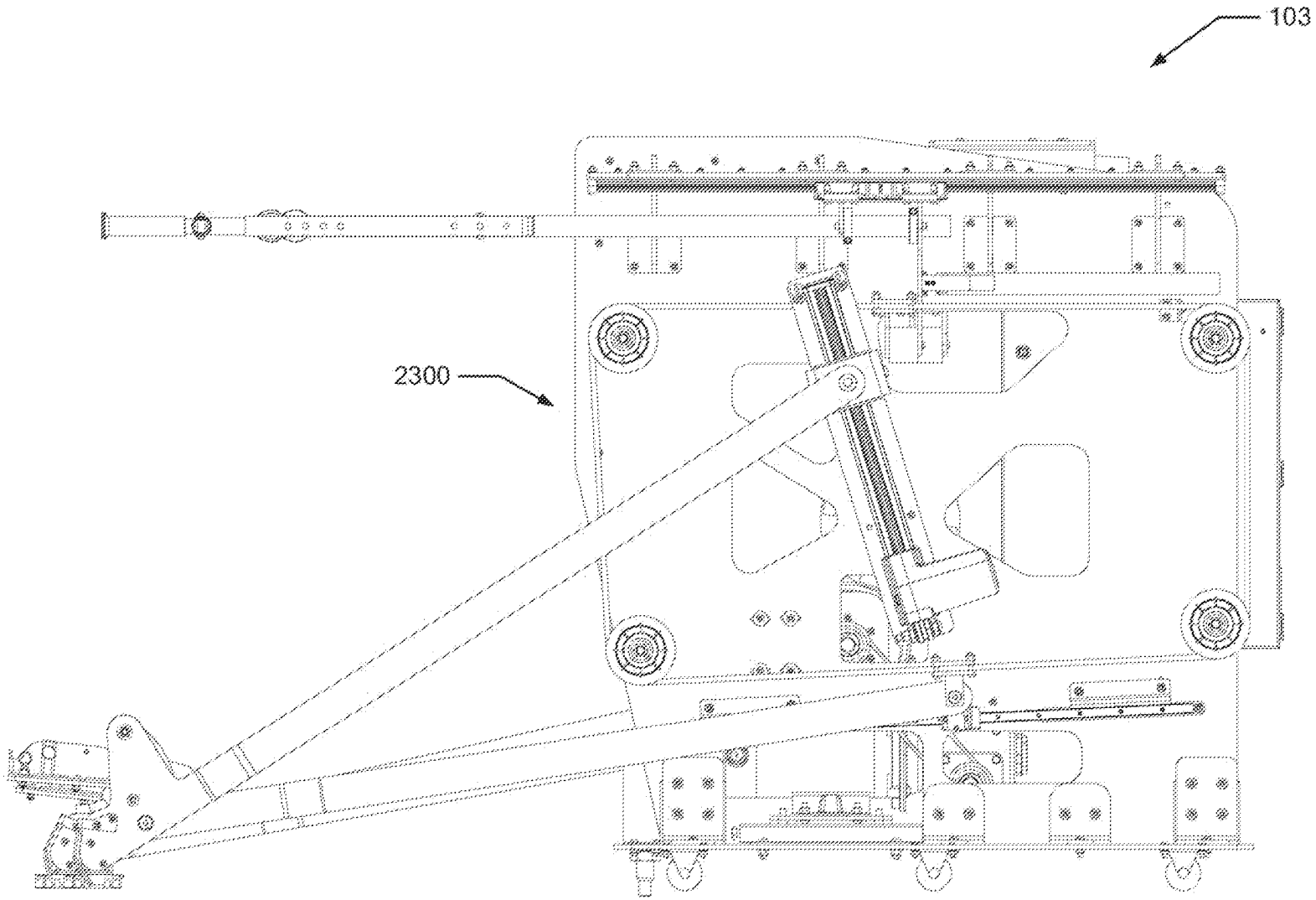
FIG. 3 shows a side view of an example linkage system, in accordance with the disclosed technology.
Figure 4:
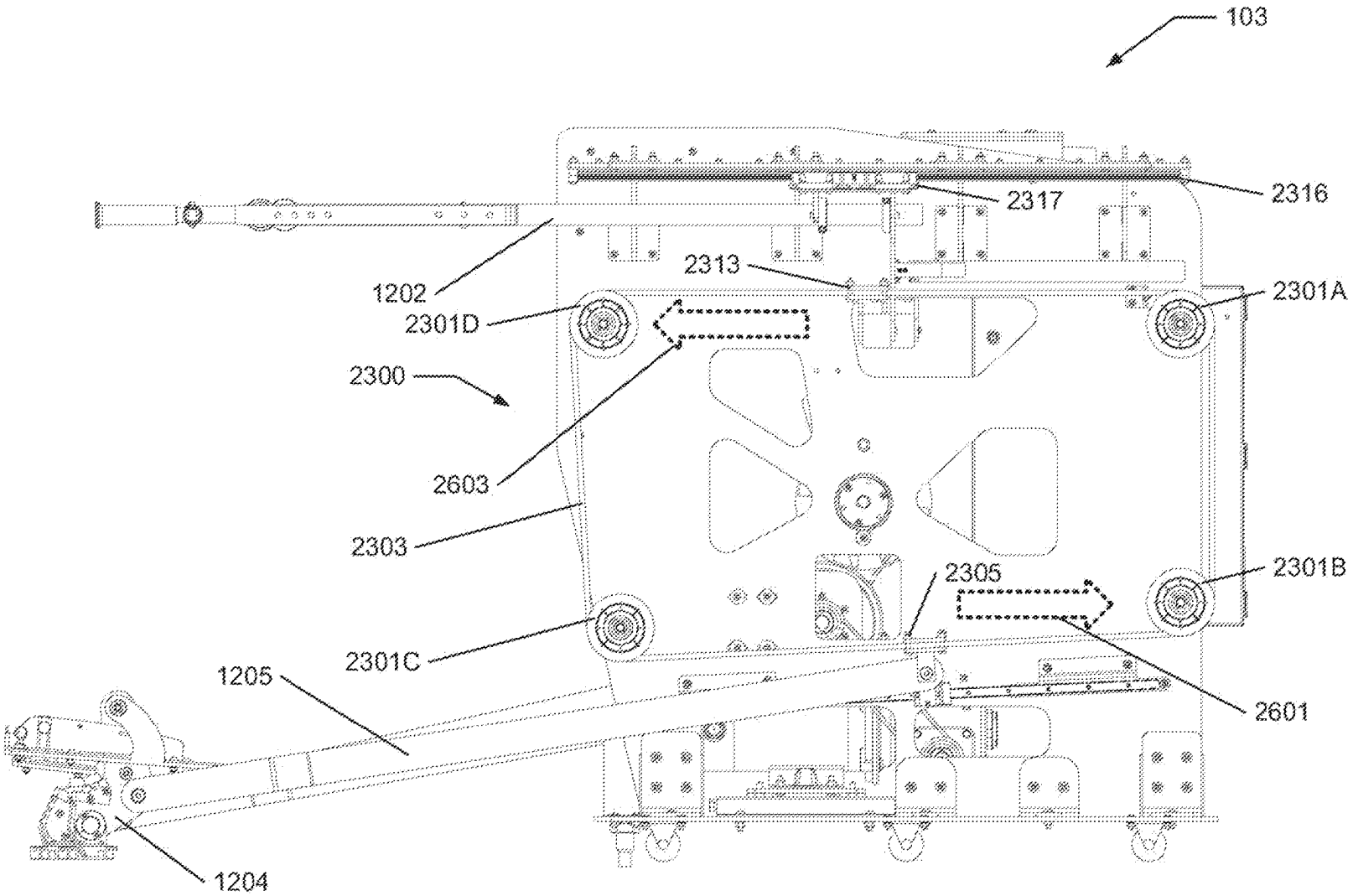
FIG. 4 shows a side view of an example linkage system, in accordance with the disclosed technology.

FIG. 3 shows a side view of an example linkage system 2300, and for clarity of illustration and description, FIG. 4 shows a side view of an example linkage system 2300 in which the driving link 1201, outer footplate link 1203, driving link mechanism 1215, stride length track 1231, stride length actuator 1229, and driving linkage 1233 have been omitted so as to better illustrate various aspects of the linkage system 2300.

As described herein, the belt 2303 and pulley(s) 2301 can synchronize motion of the footplate 1204 and the handle 1202 by mechanically linking the two elements such that—via the belt 2303, pulleys 2301A-2301D, and inner footplate link 1205—translation of the footplate 1204 can cause reverse translation of the handle 1202.

For example, translation of the footplate 1204 in a first direction 2601 can cause the inner footplate link 1205 to translate in the first direction 2601. The translation of the inner footplate link 1205 in the first direction 2601 can cause the clamp 2305 to translate in the first direction 2601. The translation of the clamp 2305 in the first direction 2601 can cause the belt 2303 to rotate about the pulleys 2301A-2301D in a counter-clockwise direction. The counter-clockwise rotation of the belt 2303 can cause the clamp 2313 (e.g., when engaged with the belt 2303) to translate in a second direction 2603 that is opposite the first direction 2601. The translation of the clamp 2313 in the second direction 2603 can cause the handle 1202 to translate in the second direction 2603, thereby synchronizing the handle 1202 and the footplate 1204 to move in opposing directions that simulate a locomotion gait.

Figure 5:
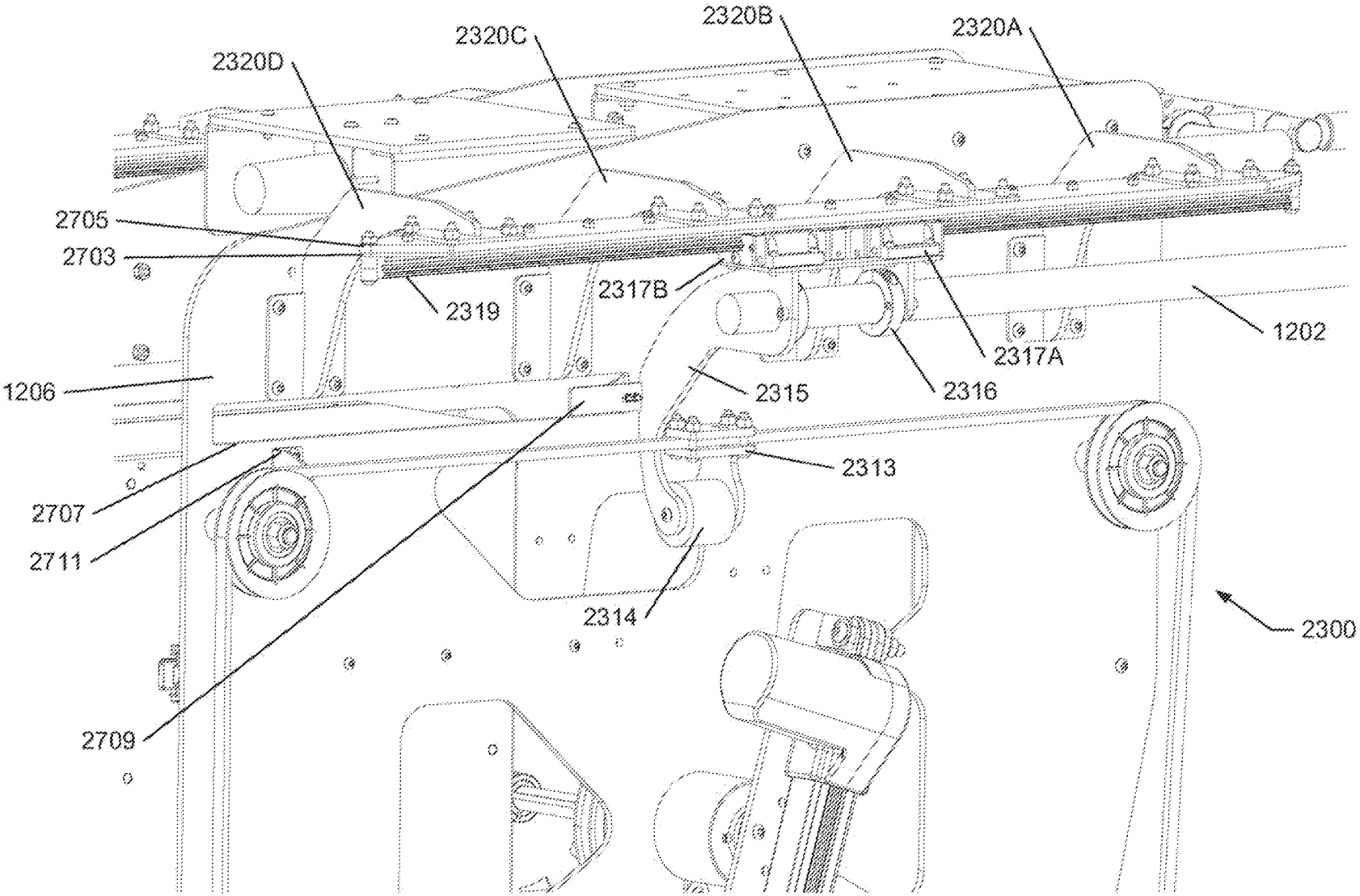
FIG. 5 shows a partial side view of an example linkage system and frame, in accordance with the disclosed technology.

FIG. 5 shows a partial side view of an example linkage system 2300 and a frame 1206. The carriage rail 2319 can include a rail plate 2703 and a rail plate stiffener 2705. The carriage rail 2319, rail plate 2703, and rail plate stiffener 2705 can be fastened together via fasteners (e.g., bolts, rivets etc.), welds, or other suitable attachment mechanisms or methods. The rail plate stiffener 2705 can improve the stiffness of the rail plate 2703 and/or carriage rail 2319 such that the elements can better accommodate a load applied to the handle 1202 (e.g., patient weight, handle augmentations, etc.).

The frame 1206 can include a void 2707 configured to provide movement clearance to one or more energy supply chains ("e-chains," not shown) that deliver energy, data, and/or signals to one or more elements of the linkage system 2300, such as the engagement mechanism 2314. The energy supply chain(s), or e-chain(s), can be or include a flexible cable carrier, such as a cable carrier comprising a plurality of links, with each link being rotatably connected to adjacent links, to thereby surround and/or guide cables and/or wires (and/or hydraulic or pneumatic hoses, if necessary) connected to moving or moveable components. They reduce wear and stress on cables and hoses, prevent entanglement, and improve operator safety. The rib 2315 can include a tab 2709 configured to attach to an e-chain such that the e-chain travels with the rib 2315 during translation. While not shown in FIG. 5, the frame 1206 can include a protrusion, void, or other mount configured to receive, secure, and support a portion of the e-chain.

The frame 1206 can include a stop mount 2711. The stop mount 2711 can be configured to hold a permanent magnet, an electromagnet, or any other mechanism for holding the rib 2315, and, thereby, the handle 1202, at a fixed position. The stop mount 2711 can include a magnet (e.g., permanent magnet, electromagnet) configured to magnetically attract and attach to the rib 2315, thereby securing the handle 1202 against translation. The linkage system 2300 can operate in a footplate-only mode and/or a fixed-handle mode in which the handle 1202 remains at a fixed position throughout movement of the footplate 1204, driving link 1201, outer footplate link 1203, and/or inner footplate link 1205. In the fixed handle mode, the handle 1202 can be secured in a fixed position via interaction with a mechanism at the stop mount 2711 and/or disconnection of the clamp 2313 from the belt 2303 (e.g., via the engagement mechanism 2314).

Figure 6:
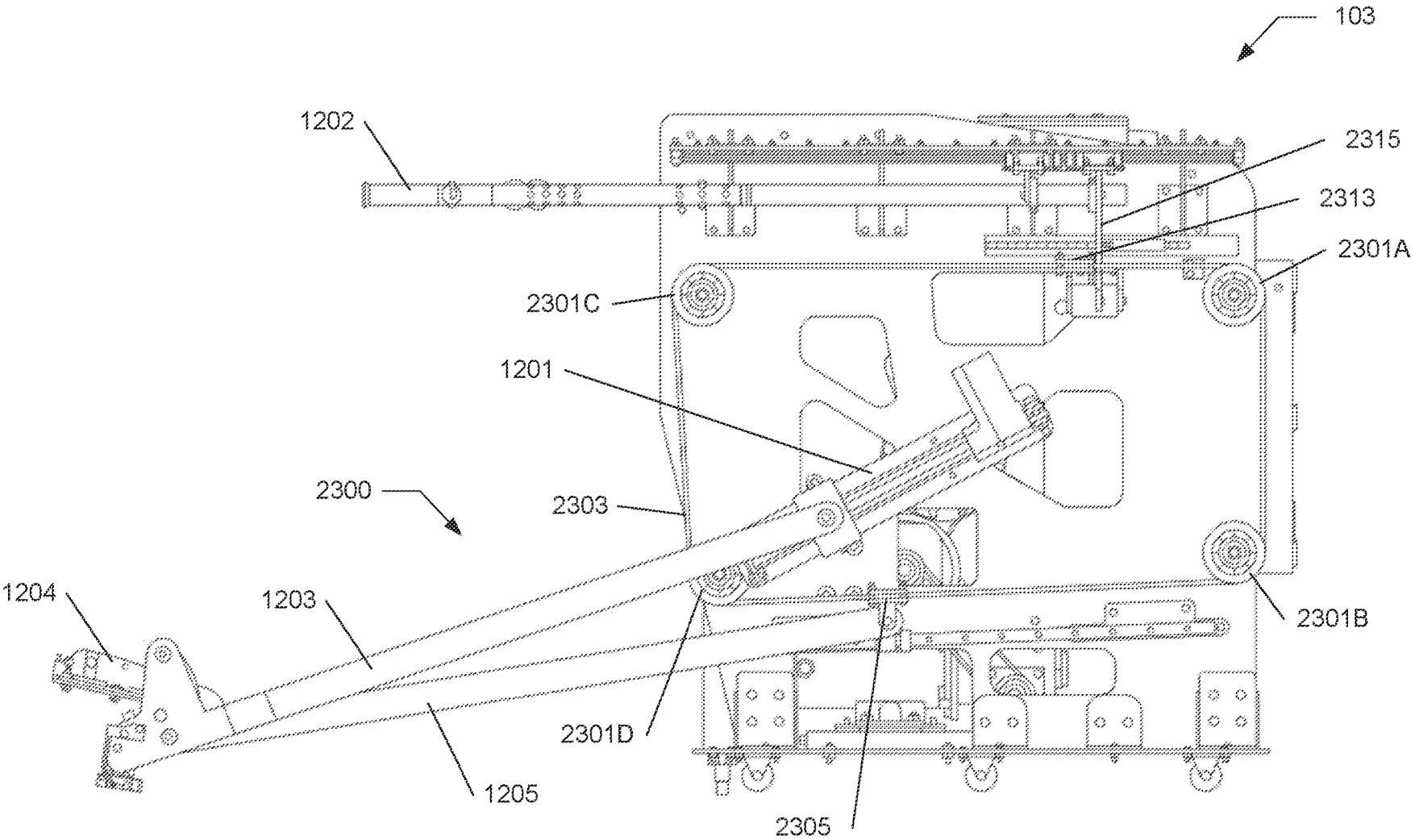
FIG. 6 shows a perspective view of an example linkage system, in accordance with the disclosed technology.

FIG. 6 shows a perspective view of an example linkage system 2300. In describing FIGS. 6-9, for illustrative and descriptive purposes, reference will be made to a single linkage system 2300; however, it understood that a sled (such as sled 103 show in FIG. 2 and described herein) may include an additional linkage system 2300 in which locomotive operation therein occurs in a reciprocal manner to locomotive operations of the single linkage system 2300 described herein. In various embodiments, FIGS. 6-9 demonstrate motion of the linkage system 2300. Additionally, FIGS. 6-9 demonstrate the ability of the disclosed technology (e.g., linkage systems 2300) to simulate foot and hand motions of a human gait cycle. In the following description, terms for certain linkage system elements can correspond to similarly named terms shown in FIGS. 1-5 and described herein. For example, the "outer footplate link" discussed with respect to FIGS. 6-9 can correspond to the outer footplate link 1203 shown in FIG. 1 and described herein.

In the linkage system 2300 shown in FIG. 6, the footplate 1204, inner footplate link 1205, and outer footplate link 1203 are shown positioned at or near a maximum reverse translation position. In various embodiments, the handle 1202 is shown positioned at or near a maximum forward translation position. As illustrated, the driving link 1201 can be positioned at a first rotational position. As further shown in FIGS. 7-9 and described herein, the driving link 1201 can rotate from the first rotational position to one or more different rotational positions (e.g., a second rotational position, a third rotational position, a fourth rotational position, etc.). The linkage system 2300 can cause opposing, synchronous translations of the handle 1202 and the footplate 1204, inner footplate link 1205, and outer footplate link 1203 via the rotation of the driving link 1201 (e.g., as transformed into translation motion by the belt 2303 and pulley(s) 2301).

Figure 7:
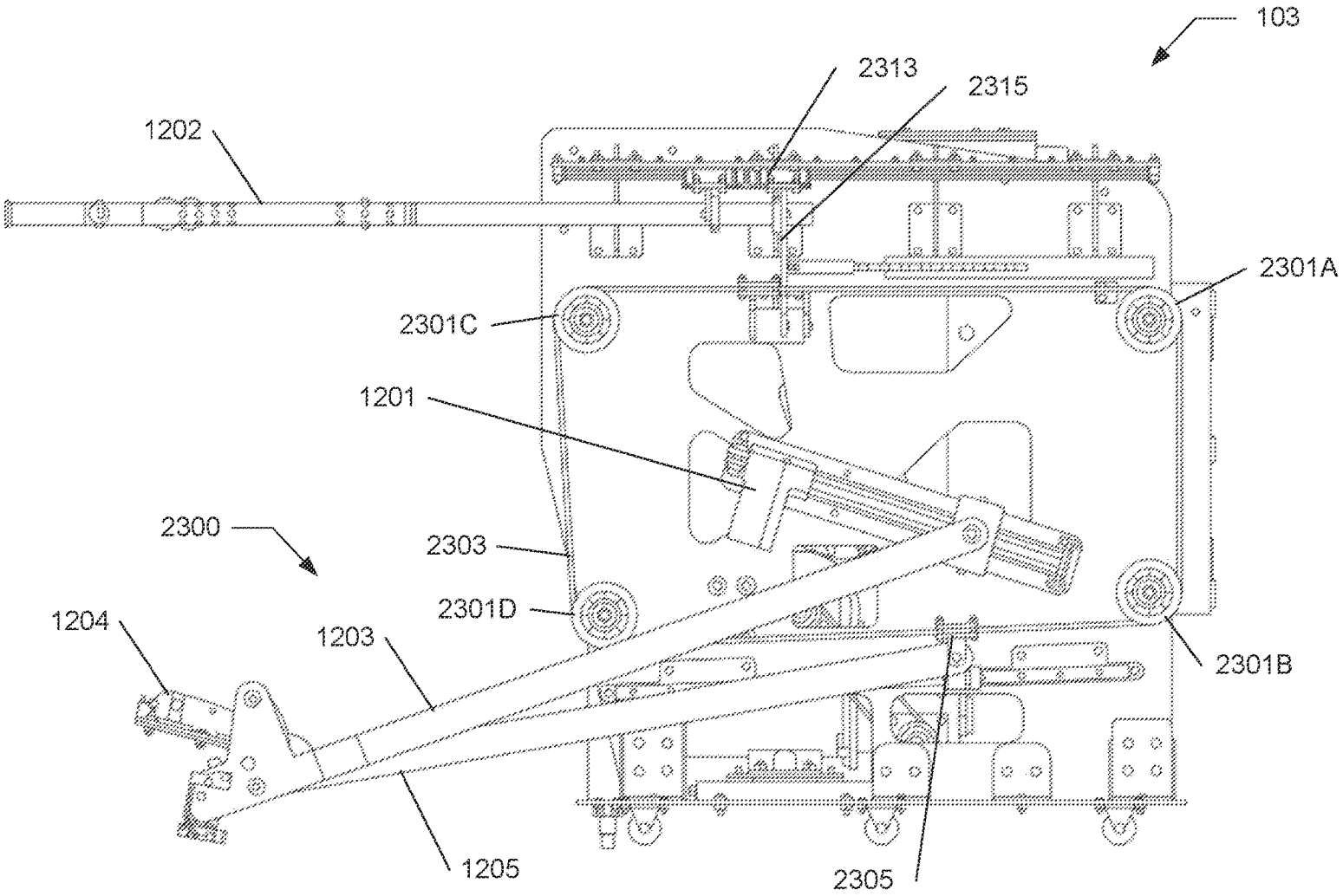
FIG. 7 shows a perspective view of an example linkage system, in accordance with the disclosed technology.

FIG. 7 shows a perspective view of an example linkage system 2300. The linkage system 2300 shown in FIG. 7 may be a temporally subsequent configuration of the linkage system 2300 as shown in FIG. 6. Stated otherwise, the disclosed linkage system 2300 can be configured to transition between the configuration illustrated by FIG. 6 and the configuration illustrated by FIG. 7, as a non-limiting example.

As the driving link 1201 rotates counterclockwise from the first rotational position to a second rotational position, the driving link 1201 can cause the connected outer footplate link 1203 to forward translate from the maximum reverse translation position. The outer footplate link 1203, being connected to the footplate 1204, causes the footplate 1204 to forward translate (e.g., in parallel fashion, such as parallel to the ground). The footplate 1204, being connected to the inner footplate link 1205, can cause the inner footplate link 1205 to forward translate (e.g., in parallel fashion, such as parallel to the ground). The inner footplate link 1205 can be connected to the first clamp 2305 and, upon forward translating, can cause the first clamp 2305 to forward translate. The first clamp 2305, being connected to the belt 2303, can cause the belt 2303 to rotate clockwise about one or more pulleys 2301 (e.g., a plurality of pulleys 2301). The belt 2303 can be connected to the second clamp 2313 and, upon rotating clockwise, causes the second clamp 2313 to reverse translate. The second clamp 2313, being connected to the handle 1202 via the rib 2315, can cause the handle 1202 to reverse translate from the maximum forward translation point.

Figure 8:
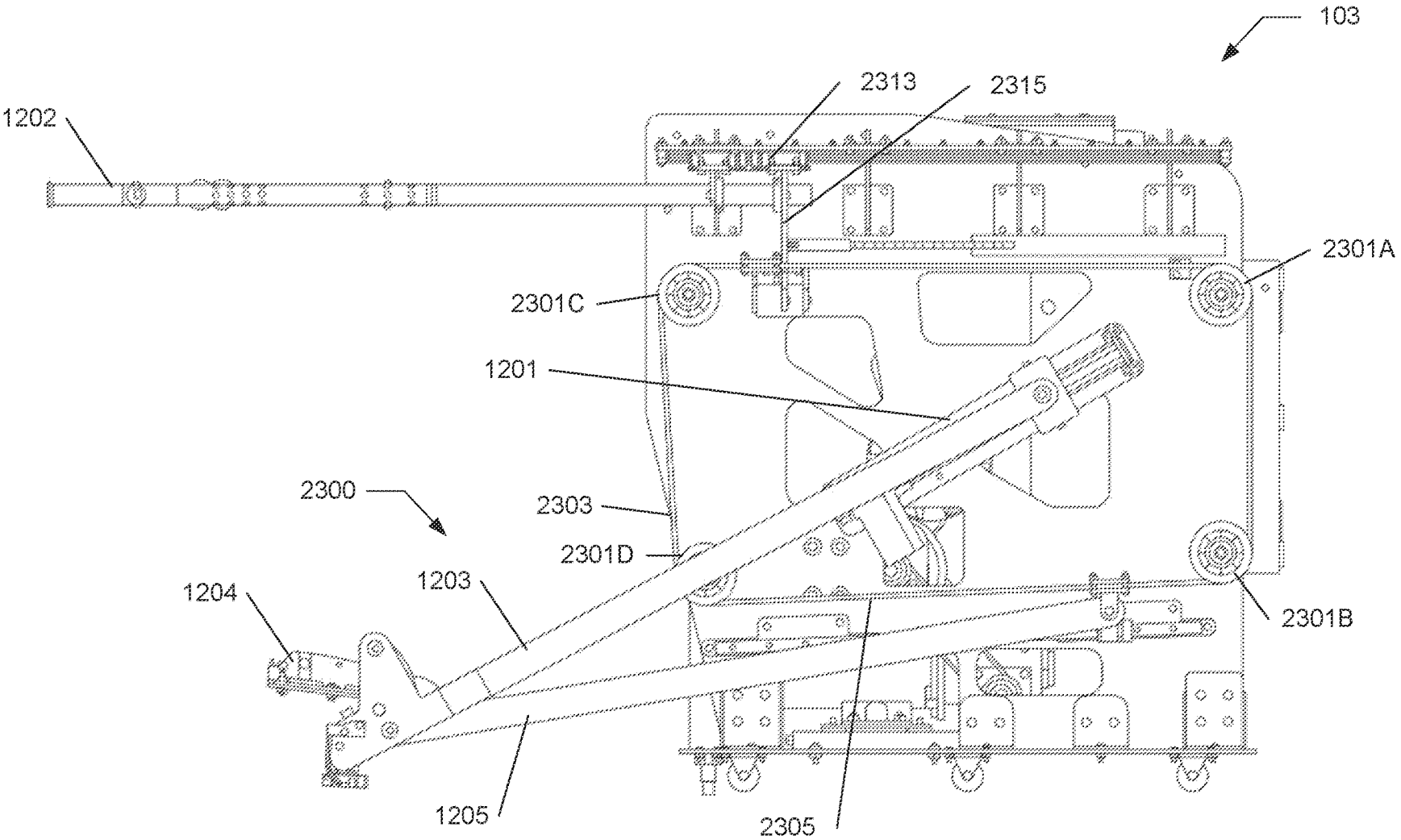
FIG. 8 shows a perspective view of an example linkage system, in accordance with the disclosed technology.

FIG. 8 shows a perspective view of an example linkage system 2300. The linkage system 2300 shown in FIG. 8 can be a temporally subsequent configuration of the linkage system 2300 as shown in FIG. 7. Stated otherwise, the disclosed linkage system 2300 can be configured to transition between the configuration illustrated by FIG. 7 and the configuration illustrated by FIG. 8, as a non-limiting example.

As the driving link 1201 rotates counterclockwise from the second rotational position to a third rotational position, the driving link 1201 can cause the outer footplate link 1203 and, thereby the footplate 1204 and inner footplate link 1205, to continue forward translating from the maximum reverse translation position toward a maximum forward translation position. The inner footplate link 1205 can cause the first clamp 2305 to continue forward translating. The first clamp 2305 can cause the belt 2303 to continue rotating clockwise about the pulley(s) 2301. The belt 2303 can cause the second clamp 2313 to continue reverse translating, thereby causing the handle 1202 to continue reverse translating from the maximum forward translation point toward a maximum reverse translation point.

Figure 9:
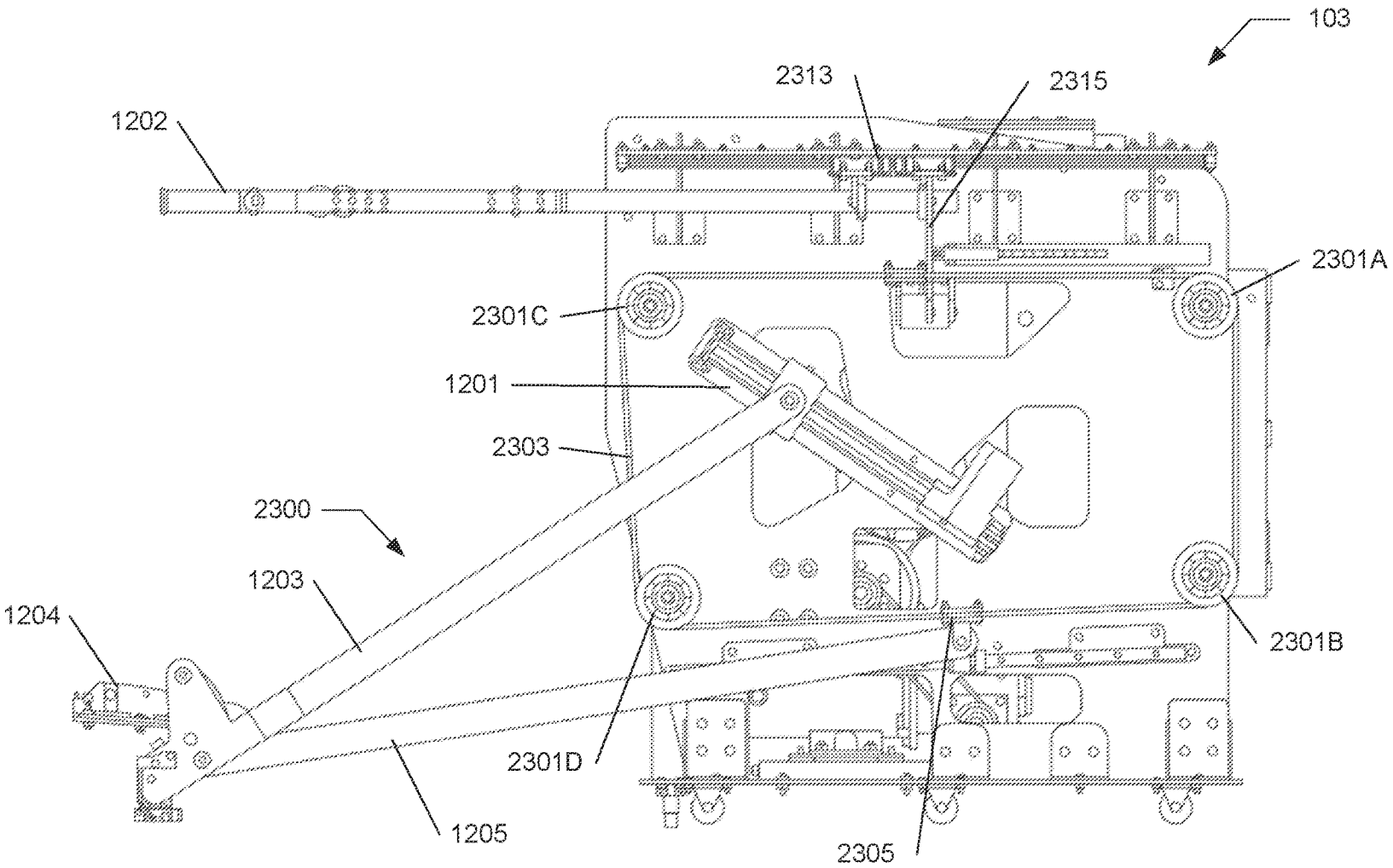
FIG. 9 shows a perspective view of an example linkage system, in accordance with the disclosed technology.

FIG. 9 shows a perspective view of an example linkage system 2300. The linkage system 2300 shown in FIG. 9 can be a temporally subsequent embodiment of the linkage system 2300 shown in FIG. 8. Stated otherwise, the disclosed linkage system 2300 can be configured to transition between the configuration illustrated by FIG. 8 and the configuration illustrated by FIG. 9, as a non-limiting example.

As the driving link 1201 rotates counterclockwise rotates counterclockwise from the third rotational position toward the first rotational position, the driving link 1201 causes reverse translation of the outer footplate link 1203 and, thereby, the footplate 1204 and the inner footplate link 1205 from the maximum forward translation point toward the maximum reverse translation point. The inner footplate link 1205 can cause the first clamp 2305 to reverse translate. The first clamp 2305 can cause the belt 2303 to rotate counterclockwise about the pulley(s) 2301. The belt 2303 can cause the second clamp 2313 to forward translate, thereby causing the handle 1202 to forward translate from the maximum reverse translation position to the maximum forward translation position.

Figure 10:
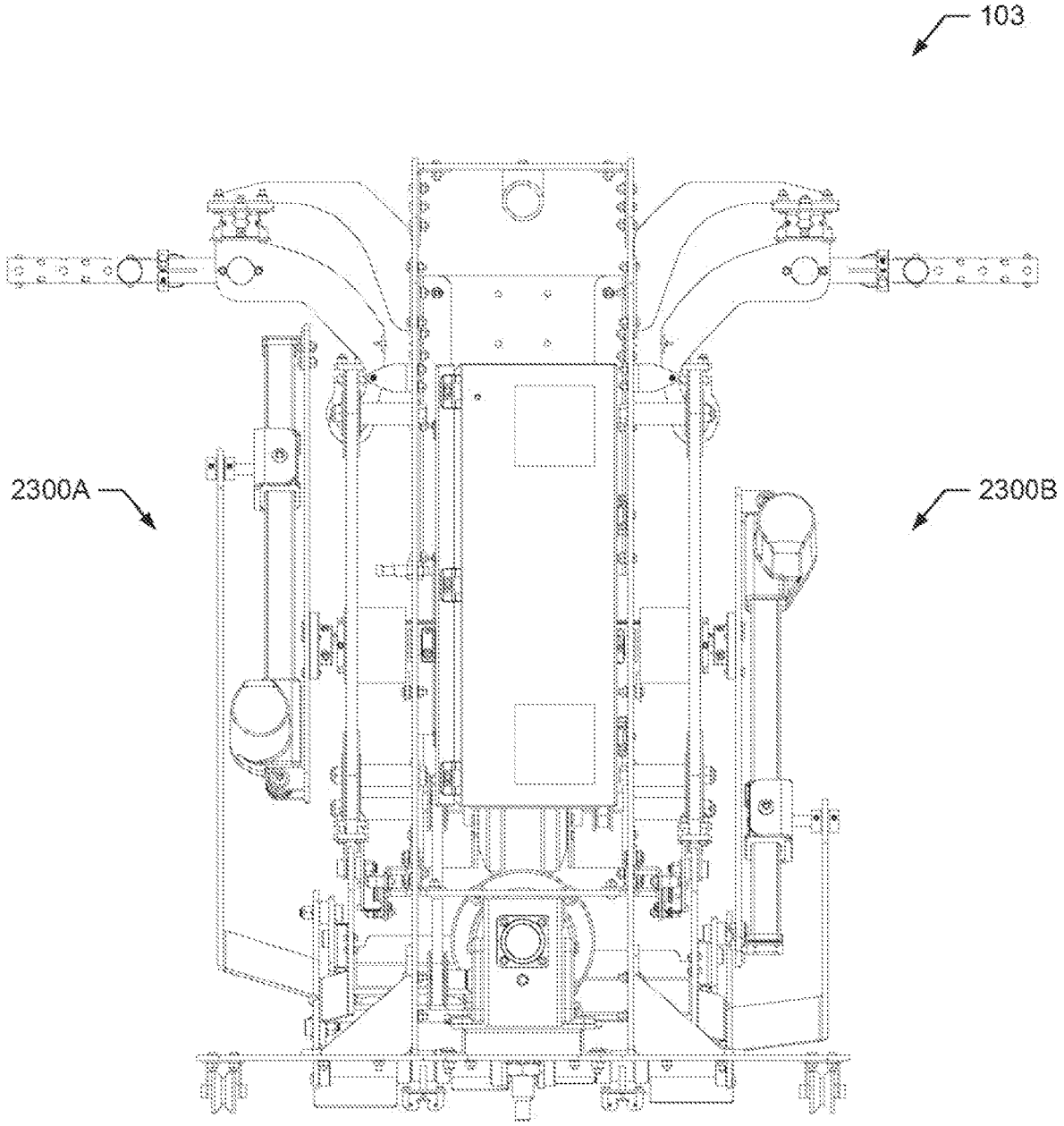
FIG. 10 shows a front view of an example sled including two linkage systems, in accordance with the disclosed technology.
Figure 11:
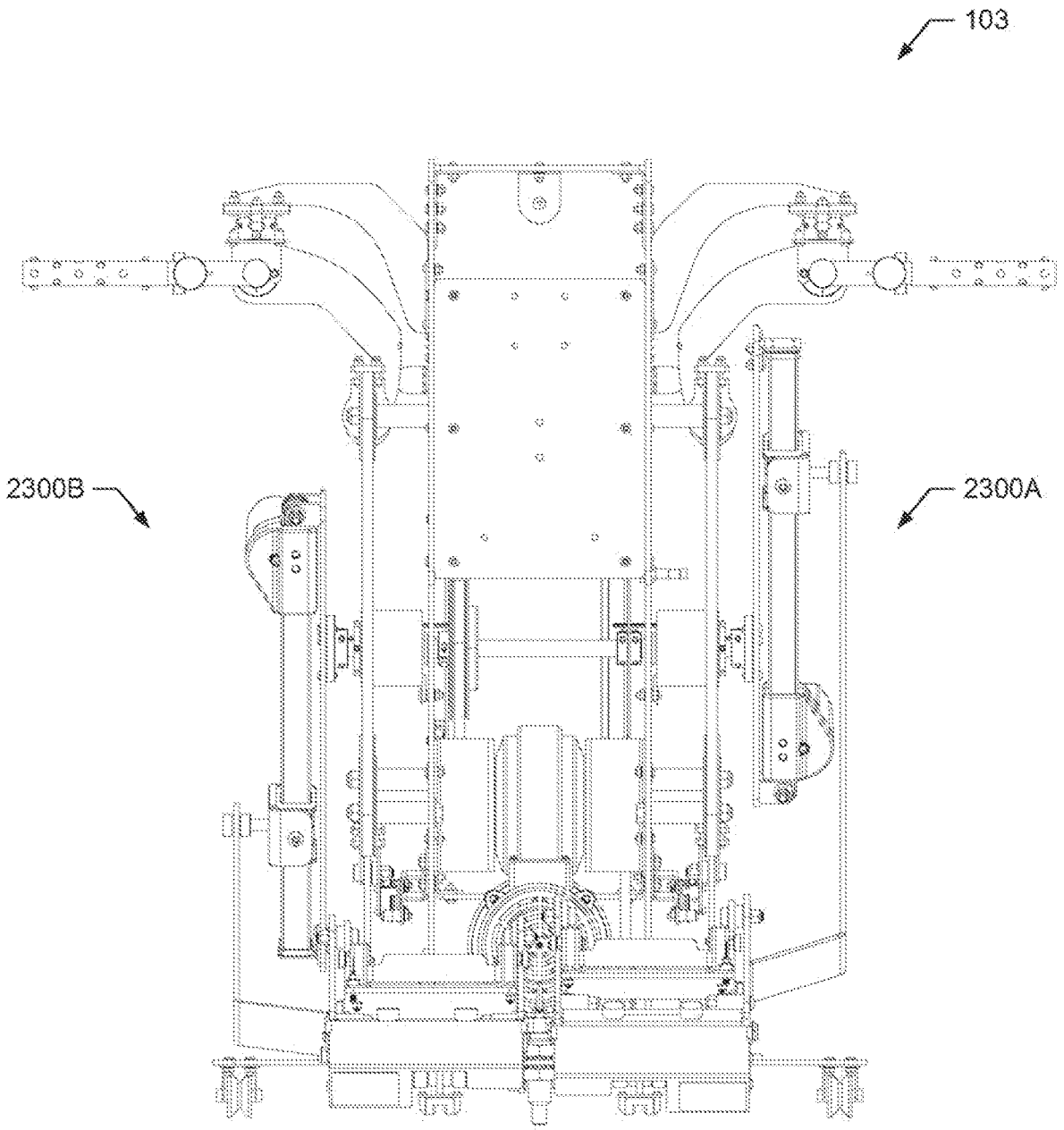
FIG. 11 shows a back view of an example sled including two linkage systems, in accordance with the disclosed technology.
Figure 12:
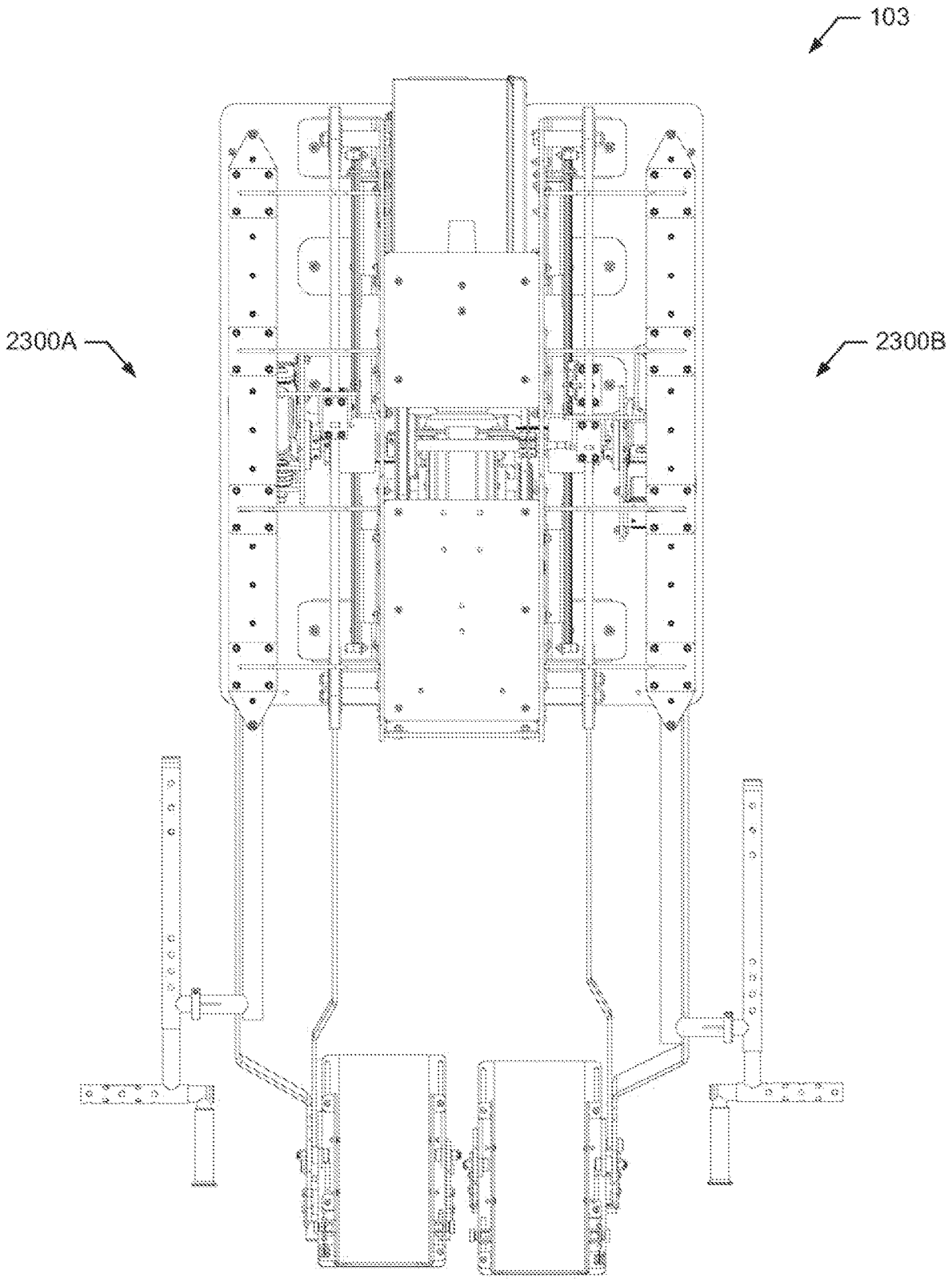
FIG. 12 shows a top view of an example sled including two linkage systems, in accordance with the disclosed technology.
Figure 13:
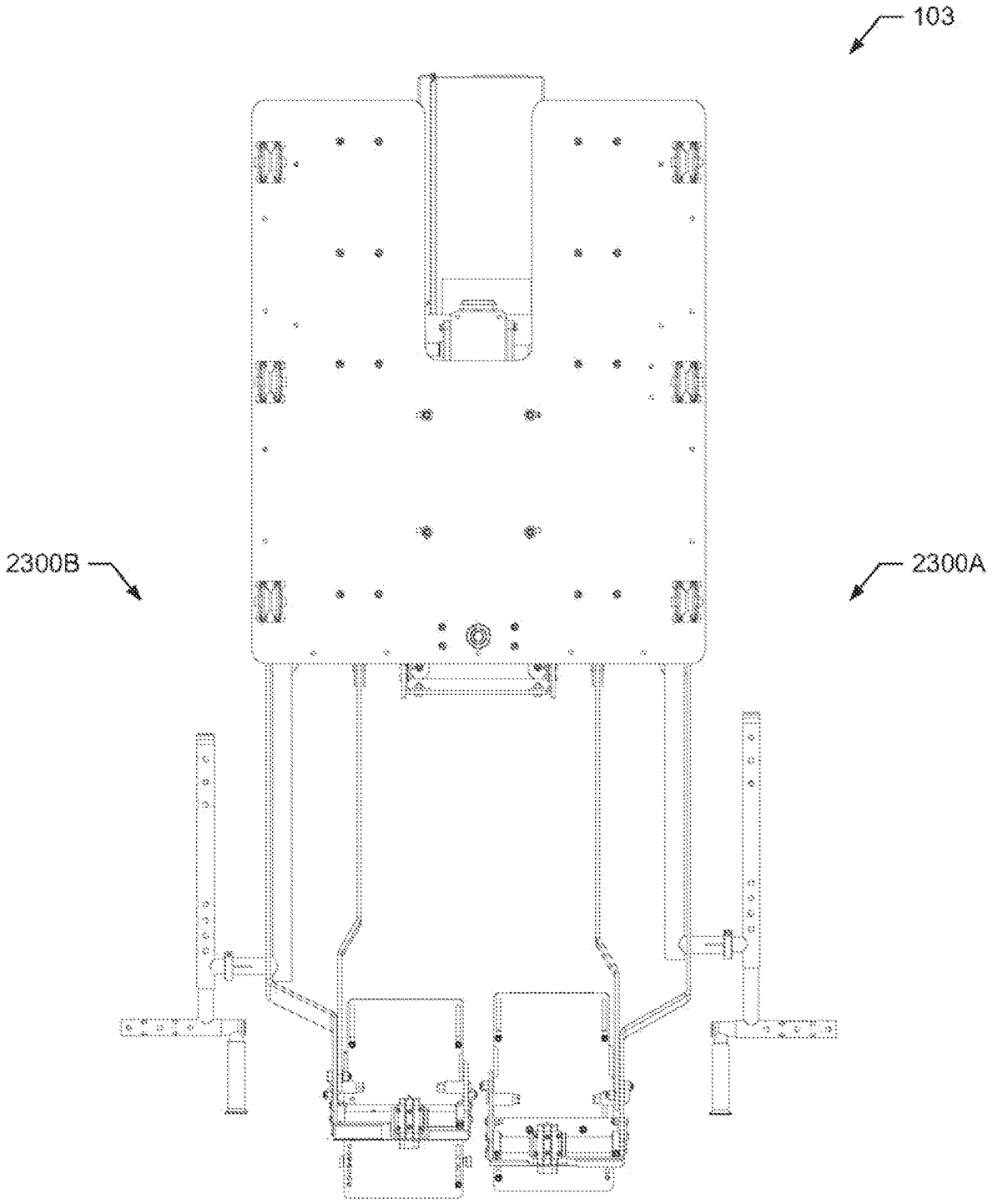
FIG. 13 shows a bottom view of an example sled including two linkage systems, in accordance with the disclosed technology.

FIGS. 10 and 11 show a front view and a rear view, respectively, of an example sled 103 including two linkage systems 2300A, 2300B. Similarly, FIGS. 12 and 13 show a top view and a bottom view, respectively, of an example sled 103 including the linkage systems 2300A, 2300B.

FIG. 14 shows a side view of an example linkage system 3600. While not explicitly shown in FIG. 14, the linkage system 3600 can include the driving link 1201, outer footplate link 1203, driving link mechanism 1215, stride length track 1231, stride length actuator 1229, and/or driving linkage 1233 (see, e.g., the linkage system 2300 as shown and described with respect to FIG. 1). Further, while not necessarily explicitly depicted by FIG. 14, the driving link 1201 can rotate and cause translation of the outer footplate link 1203 or handle 1202, thereby engaging the linkage system 3600 to initiate a synchronized translation of the handle 1202 and/or footplate 1204.

The linkage system 3600 can include one or more pulleys 2301 (e.g., two pulleys 2301A, 2301B) and a belt 2303 configured to rotate about the pulley(s) 2301. A first portion of the belt 2303 can be connected to the first clamp 2305, and a second portion of the belt 2303 can be connected to the second clamp 2313 (e.g., via fasteners and/or an engagement mechanism, not shown). In response to motion of the driving link 1201 and outer footplate link 1203 (not shown), the footplate 1204 and inner footplate link 1205 can translate in the first direction 2601. The inner footplate link 1205 can cause the first clamp 2305 to translate in the first direction 2601. The first clamp 2305 can cause the belt 2303 to rotate about the pulley(s) 2301. The belt 2303 can cause the second clamp 2313 to translate in a second direction 2603. The clamp 2313 can cause the handle 1202 to translate in the second direction 2603, thereby synchronizing movement of the handle 1202 and the footplate 1204.

FIG. 15 shows a side view of an example linkage system 3700. While not explicitly depicted by FIG. 15, the linkage system 3700 can include a driving link 1201, outer footplate link 1203, driving link mechanism 1215, stride length track 1231, stride length actuator 1229, and/or driving linkage 1233 (the linkage system 2300 as shown and described with respect to FIG. 1). Further, while not necessarily explicitly depicted by FIG. 15, the driving link 1201 can rotate and cause translation of the outer footplate link 1203 and/or handle 1202, thereby engaging the linkage system 3700 to initiate a synchronized translation of the handle 1202 or footplate 1204.

The linkage system 3600 can include a single pulley 2301 (or multiple pulleys 2301) and the belt 2303, which can be configured to rotate about the pulley 2301. The first end of the belt 2303 can be connected to the first clamp 2305, and the second end of the belt 2303 can be connected to the second clamp 2313 (e.g., via fasteners and/or an engagement mechanism, not shown). In response to motion of the driving link 1201 and/or outer footplate link 1203 (not shown), the footplate 1204 and/or inner footplate link 1205 can translate in the first direction 2601. The inner footplate link 1205 can cause the first clamp 2305 to translate in the first direction 2601. The first clamp 2305 can cause the belt 2303 to rotate about the pulley 2301. The belt 2303 can cause the second clamp 2313 to translate in the second direction 2603. The clamp 2313 can cause the handle 1202 to translate in the second direction 2603, thereby synchronizing movement of the handle 1202 and the footplate 1204.

The linkage system 3700 can include a spring 3705 connected to the handle 1202. The spring 3705 can be configured to oppose translation of the handle 1202 in the second direction 2603 (e.g., the spring 3705 is biased to pull the handle 1202 in the first direction 2601). For example, upon translation of the handle 1202 in the second direction 2603, the spring 3705 can apply a force to the handle 1202 in the first direction 2601. The linkage system 3707 can include an actuator configured to controllably stretch the spring 3705 and, thereby, adjust a magnitude of force applied by the spring 3705 to the handle 1202. As the footplate 1204, inner footplate link 1205, and/or outer footplate link 1203 (not shown) translate in the second direction 2603, the inner footplate link 1205 can cause the first clamp 2305 to translate in the second direction 2603, thereby removing the force that caused the belt 2303 to rotate about the pulley 2301. As the first clamp 2305 translates in the second direction 2603, the spring 3705 can cause the handle 1202 and second clamp 2313 to translate in the first direction 2601. The second clamp 2313 can cause the belt 2303 to counter-rotate about the pulley 2301, thereby resetting the linkage system 3700 to the configuration shown in FIG. 15.

Figure 16:
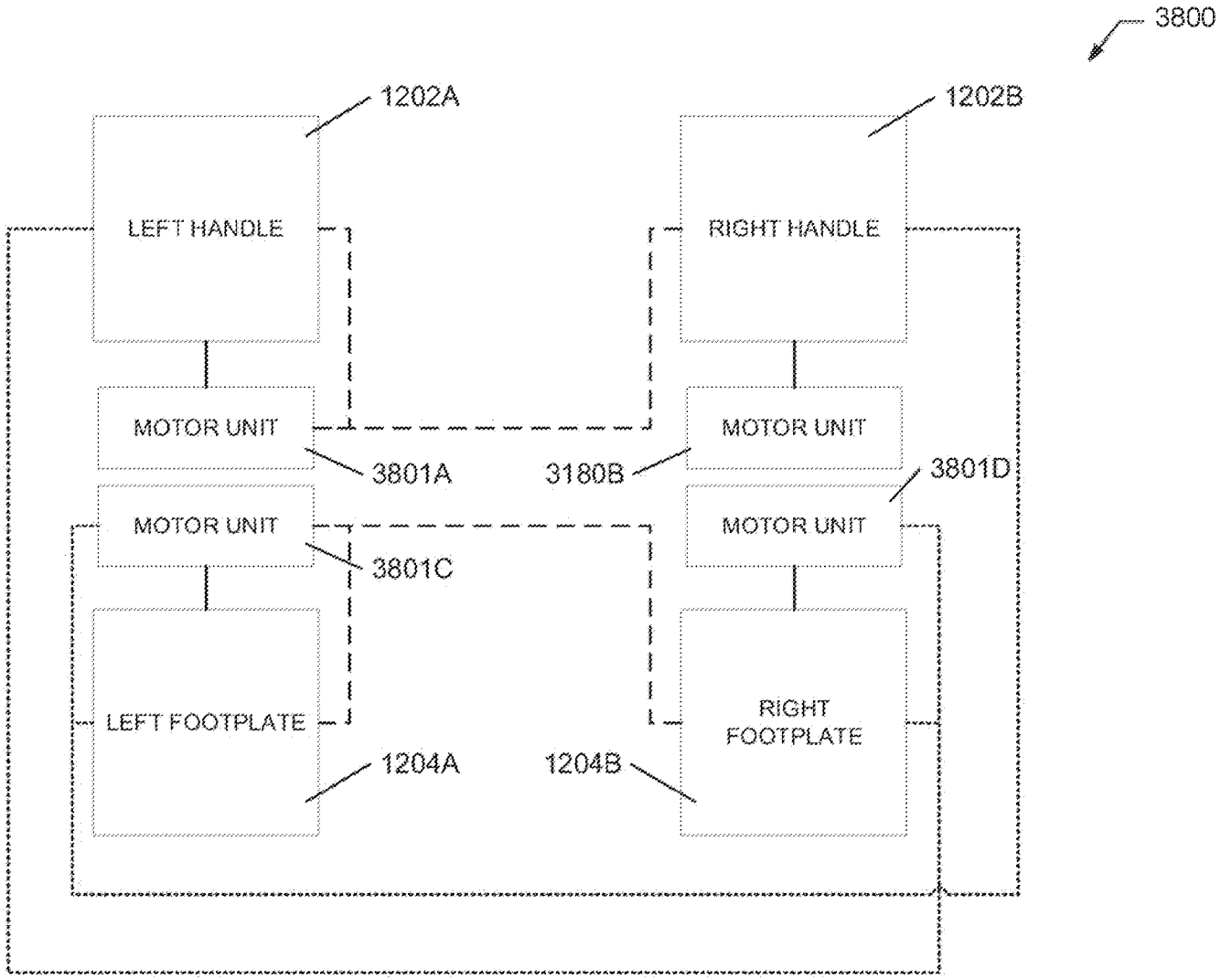
FIG. 16 shows a diagram of an example gait system, in accordance with the disclosed technology.

FIG. 16 shows a diagram of an example gait system 3800. The footplates 1204 and handles 1202 described herein can be configured to translate in response input from one or more motor units (e.g., in response to motion generated by the one or more motor units). The gait system 3800 can include one or more motor units 3801A, 3801B, 3801C, 3801D (e.g., actuators, which can include one or more of an electric motor, a stepper motor, a screw jack, a servomechanism, a solenoid cylinder, a hydraulic cylinder, or any combination thereof, as non-limiting examples) configured to power and control one or more handles 1202A, 1202B and/or footplates 1204A, 1204B. A single motor unit can be configured to power (e.g., move) one or more linkage systems (see, e.g., linkage system 2300A, 2300B shown in FIG. 2 and described herein). For example, while not necessarily explicitly show in FIG. 16, a first motor unit 3801A can power a first linkage system 2300 configured to synchronize motion of the left handle 1202A and the left footplate 1204A, and a second motor unit 3801B can power a second linkage system 2300 configured to synchronize motion of the right handle 1202B and the right footplate 1204B.

Each motor unit 3801A-3801D can independently power and control a different element of the gait system 3800. For example, as represented in FIG. 16 by the solid connection lines, the first motor unit 3801A can power the left handle 1202A, the second motor unit 3801B can power the right handle 1202A, the third motor unit 3801C can power the left footplate 1204A, and the fourth motor unit 3801D can power the right footplate 1204B. Alternatively, a given motor unit 3801 can be configured to power multiple elements of the gait system 3800 (e.g., via directly delivered power or by powering a linkage system, such as a linkage system 2300, configured to synchronize motion of two or more gait system elements). For example, as represented in FIG. 16 by the broad dashed connection lines, the first motor unit 3801A can power the left handle 1202A and the right handle 1202B, and the third motor unit 3801C can power the left footplate 1204A and the right footplate 1204B. As another example, as represented in FIG. 16 by the narrow dashed connection lines, the fourth motor unit 3801D can power the left handle 1202A and the right footplate 1204B, and the third motor unit 3801C can power the right handle 1202B and the left footplate 1204A. The disclosed technology is not so limited, however, and any combination of motor units 3801 can be used to power any desired number of components of elements of the gait system 3800, in conjunction with one or more linkage systems 2300, as necessary. To that end, a gait system 3800 having fewer motor units 3801 than powered components will generally require one or more linkage systems 2300.

The discussion herein has been primarily directed to systems and methods relating to locomotion rehabilitation systems (or similar systems) that can include one or more handle systems. The handle systems described herein can include, or be used in conjunction with, various components including various a linkage system (e.g., linkage system 2300), one or more electromagnets (e.g., engagement mechanism 2314), one or more motor units and/or actuators (e.g., motor unit(s) 3801), and/or other components, sub-components, assemblies, sub-assemblies, systems, or sub-systems, as described herein. It is to be understood that one, some, or all of such components, sub-components, assemblies, sub-assemblies, systems, or sub-systems can be in electronic communication with an electronic controller. The controller can be configured to control the operation of one, some, or all components discloses herein. The controller can include one or more processors and memory having instructions stored thereon that, when executed by the one or more processors, cause the controller to perform one or actions or operations. For example, the controller can thus be configured to output instruction to one or more components of the gait system 3800 and/or linkage system(s) 2300.

The controller can include, or be in electronic communication with, a user interface ("U/I") device for receiving user input data, and the controller can be configured to receive user input via the U/I device. Based upon stored instructions and/or receiver user input, the controller can be configured to operate in a given mode, at a given stride length, at a given speed, and/or at a given amount of power-assist (e.g., the amount of power transferred to the footplate 1204 and/or the handle 1202 from the driving link mechanism 1215 and/or motor unit). For example, the controller can be configured to operate in a natural gait mode, an impaired gait mode, an assisted gait mode, a left-preferential gait mode, a right-preferential gait mode, a shuffling gait mode, a step-by-step gait mode, a footplate-only mode (and/or a fixed-handle mode), or a handle-only mode (and/or a fixed-footplate mode). Alternatively or in addition, the controller can be configured to output instructions for one or more components to adjust the stride length (e.g., via the stride length actuator 1229, by adjusting the position of the driving linkage 1233 along the stride length track 1231). Alternatively or in addition, the controller can be configured to output instructions for one or more components (e.g., the motor unit) to adjust the speed and/or power-assist at which the linkage system 2300 is operating.

While various aspects have been described in the context of a preferred embodiment, additional aspects, features, and methodologies of the claimed systems will be readily discernible from the description herein, by those of ordinary skill in the art. Many embodiments and adaptations of the disclosure and claimed systems other than those herein described, as well as many variations, modifications, and equivalent arrangements and methodologies, will be apparent from or reasonably suggested by the disclosure and the foregoing description thereof, without departing from the substance or scope of the claims. Furthermore, any sequence (s) and/or temporal order of steps of various processes described and claimed herein are those considered to be the best mode contemplated for carrying out the claimed systems. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed systems. In addition, some steps may be carried out simultaneously, contemporaneously, or in synchronization with other steps.

Aspects, features, and benefits of the claimed devices and methods for using the same will become apparent from the information disclosed in the exhibits and the other applications as incorporated by reference. Variations and modifications to the disclosed systems and methods may be effected without departing from the spirit and scope of the novel concepts of the disclosure.

It will, nevertheless, be understood that no limitation of the scope of the disclosure is intended by the information disclosed in the exhibits or the applications incorporated by reference; any alterations and further modifications of the described or illustrated embodiments, and any further applications of the principles of the disclosure as illustrated therein are contemplated as would normally occur to one skilled in the art to which the disclosure relates.

The foregoing description of the example embodiments has been presented only for the purposes of illustration and description and is not intended to be exhaustive or to limit the devices and methods for using the same to the precise forms disclosed. Many modifications and variations are possible in light of the above teaching.

The embodiments were chosen and described in order to explain the principles of the devices and methods for using the same and their practical application so as to enable others skilled in the art to utilize the devices and methods for using the same and various embodiments and with various modifications as are suited to the particular use contemplated. Alternative embodiments will become apparent to those skilled in the art to which the present devices and methods for using the same pertain without departing from their spirit and scope. Accordingly, the scope of the present devices and methods for using the same is defined by the appended claims rather than the foregoing description and the example embodiments described therein.

What is claimed is:

1. A system comprising:

a driving link configured to rotate in a rotational direction;

a first footplate link in mechanical communication with the driving link, the first footplate link being configured to translate in a first direction in response to rotation of the driving link in the rotational direction;

a footplate in mechanical communication with the first footplate link such that the footplate is configured to translate in the first direction when the first footplate link translates in the first direction;

a pulley system comprising:

one or more pulleys; and a belt in mechanical communication with the one or more pulleys;

a second footplate link in mechanical communication with the first footplate link and a first fixed belt position on the belt, wherein the second footplate link is configured to translate in the first direction when the first footplate link translates in the first direction, thereby causing the first fixed belt position to translate in the first direction and a second fixed belt position to translate in a second direction that is substantially opposite the first direction; and a handle in mechanical communication with the second fixed belt position of the belt when the handle is in an engaged state such that when the footplate translates in the first direction, the handle translates in the second direction.

2. The system of claim 1, wherein the second footplate link is in mechanical communication with the first footplate link via the footplate.

3. The system of claim 1, wherein:

the rotational direction is a first rotational direction, and the belt is configured to rotate in a second rotational direction when the driving link rotates in the first rotational direction, the second rotational direction being opposite the first rotational direction.

4. The system of claim 1, wherein the handle is selectively detachable from the second fixed belt position, the handle being in a disengaged state when the handle is detached from the second fixed belt position.

5. The system of claim 4, wherein the system further comprises an engagement system configured to transition the handle between the engaged state and the disengaged state.

6. The system of claim 5, wherein the engagement system is configured to transition the handle between the engaged state and the disengaged state in response to receiving an instruction signal from a computing device.

7. The system of claim 5 further comprising a handle restraining element configured to restrict translation of the handle when the handle is in the disengaged state.

8. The system of claim 7 further comprising a rib attached to the handle and disposed between the handle and a handle attachment point configured to selectively engage the second fixed belt position, wherein the handle restraining element comprises a magnet configured to magnetically attach to the rib to thereby restrict translation of the handle when the handle is in the disengaged state.

9. The system of claim 1, wherein the driving link is in mechanical communication with a motor.

10. The system of claim 1 further comprising a carriage configured to translate along a carriage rail extending parallel to the first direction and the second direction, the carriage being in mechanical communication with the second footplate link to thereby stabilize translation of the second footplate link.

11. The system of claim 1 further comprising:

a stride length track; and a driving linkage connecting the driving link to the first footplate link, the driving linkage being configured to traverse along the stride length track, wherein a position of the driving linkage along the stride length track corresponds to a magnitude of translation for the first footplate link.

12. The system of claim 11 further comprising a stride length actuator configured to controllably adjust the position of the driving linkage along the stride length track.

13. The system of claim 12, wherein the stride length actuator is configured to adjust the position of the driving linkage along the stride length track in response to receiving an instruction signal from a computing device.

14. The system of claim 1 further comprising a controller configured to selectively operate the system according to any one of a plurality of gait speeds or any one of a plurality of power-assist levels.

15. A system comprising:

a sled;

a first linkage system and a second linkage system, both the first and second linkage systems being attached to the sled and comprising:

a driving link configured to rotate in a rotational direction;

a first footplate link in mechanical communication with the driving link, the first footplate link being configured to translate in a first direction in response to rotation of the driving link in the rotational direction;

a footplate in mechanical communication with the first footplate link such that the footplate is configured to translate in the first direction when the first footplate link translates in the first direction;

a pulley system comprising:

one or more pulleys; and a belt in mechanical communication with the one or more pulleys;

a second footplate link in mechanical communication with the first footplate link and a first fixed belt position of the belt, wherein the second footplate link is configured to translate in the first direction when the first footplate link translates in the first direction, thereby causing the first fixed belt position to translate in the first direction and a second fixed belt position to translate in a second direction that is substantially opposite the first direction; and a handle in mechanical communication with the second fixed belt position of the belt when the handle is in an engaged state such that when the footplate translates in the first direction, the handle translates in the second direction, wherein the footplate of the first linkage system and the handle of the second linkage system are configured to translate in the second direction when the footplate of the second linkage system and the handle of the first linkage system translate in the first direction.

16. The system of claim 15, wherein for each of the first and second linkage systems, the second footplate link is in mechanical communication with the first footplate link via the footplate.

17. The system of claim 15, wherein for each of the first and second linkage systems, the handle is selectively detachable from the second fixed belt position, the handle being in a disengaged state when the handle is detached from the second fixed belt position.

18. The system of claim 17, wherein each of the first and second linkage systems further comprise an engagement system configured to transition the corresponding handle between the engaged state and the disengaged state.

19. The system of claim 15, wherein each of the first and second linkage systems further comprise:

a stride length track; and a driving linkage connecting the driving link to the first footplate link, the driving linkage being configured to traverse along the stride length track, wherein a position of the driving linkage along the stride length track corresponds to a magnitude of translation for the first footplate link.

20. The system of claim 19, wherein each of the first and second linkage systems further comprise a stride length actuator configured to controllably adjust the position of the driving linkage along the stride length track.

* * * * *